US005596844A

United States Patent [19]

Kalinowski

[11] Patent Number: 5,596,844

[45] Date of Patent: Jan. 28, 1997

[54] FOLDABLE PORTABLE BUILDING

[76] Inventor: Juan R. Kalinowski, 21669- 50B Avenue, Langley, British Columbia, Canada, V3A 8B9

[21] Appl. No.: 383,172

[22] Filed: Feb. 3, 1995

[51] Int. Cl.[6] ..... E04H 1/12; E04B 7/16

[52] U.S. Cl. ..... 52/79.5; 52/66; 52/67; 52/68; 52/69; 52/71; 52/92.2; 52/122.1; 52/641

[58] Field of Search ..... 52/64, 66, 67, 52/68, 69, 70, 71, 79.5, 90.2, 92.2, 641, 79.1, 122.1, 125.2

[56] References Cited

U.S. PATENT DOCUMENTS

| | | | |
|---|---|---|---|
| 2,805,884 | 9/1957 | Kinsman | 52/66 X |
| 2,886,856 | 5/1959 | Che | 52/69 |
| 3,168,762 | 2/1965 | Laidler | 52/70 |
| 3,348,344 | 10/1967 | Tatevossian | 52/22 |
| 3,445,134 | 5/1969 | Pair et al. | 52/64 X |
| 3,629,982 | 12/1971 | Ballay et al. | 52/69 |
| 3,653,165 | 4/1972 | West | 52/67 |
| 3,701,225 | 10/1972 | Perry | 52/71 |
| 3,866,365 | 2/1975 | Honigman | 52/66 X |
| 3,998,013 | 12/1976 | Barnett | 52/69 |
| 4,118,901 | 10/1978 | Johnson | 52/66 X |
| 4,633,626 | 1/1987 | Freeman et al. | 52/69 X |
| 4,635,412 | 1/1987 | Le Poittevin | 52/79 |
| 4,741,133 | 5/1988 | Kutzner | 52/79 |
| 4,780,996 | 11/1988 | Julien, Jr. | 52/68 |
| 4,891,919 | 1/1990 | Palibroda | 52/79 |

FOREIGN PATENT DOCUMENTS

| | | | |
|---|---|---|---|
| 2238823 | 2/1975 | France | 52/66 |
| 2549420 | 5/1976 | Germany | 52/66 |
| 699753 | 11/1953 | United Kingdom | 52/68 |
| WO8604630 | 8/1986 | WIPO . | |
| WO93/20297 | 10/1993 | WIPO | 52/64 |

*Primary Examiner*—Wynn E. Wood
*Assistant Examiner*—Laura A. Saladino
*Attorney, Agent, or Firm*—Bull, Housser & Tupper

[57] ABSTRACT

A foldable portable building can be collapsed to fit within the outside dimensions of an internationally standardized (ISO) goods container to facilitate mechanical handling and transportation. The building comprises a rigid main support having a main floor section, a main wall section and a main roof section. When the building is extended, generally horizontal and planar, hingedly interconnected floor sections and roof sections extend from the main floor and roof sections respectively, and wall sections extend between the said sections. The wall sections comprise an end wall section, two first wall sections and two second wall sections which are hingedly interconnected similarly to a bellows. When the building is collapsed, the wall sections are located adjacent the main wall section, the roof sections are disposed vertically on a side of the wall sections remote from the main wall section, and the floor sections are disposed vertically outwardly of the folded wall and roof sections. The roof sections form a foldable roof system comprising a base ceiling member, trusses and an outer roof member. The trusses are parallel to each other and extend generally across and are hinged to the base ceiling member. The outer roof members lie on chords of the trusses. Minimal vertical space is required for the collapsed roof system which enables a relatively high ceiling to be obtained, and yet still fit within the standardized container sizing.

29 Claims, 17 Drawing Sheets

FOLDABLE PORTABLE BUILDING

BACKGROUND OF THE INVENTION

1. Field of the Invention

This invention relates to a pre-fabricated, foldable, portable building which retracts to a parallelepiped box-like structure having an external shape, dimensions, handling, securing, and external load capacity which are compatible to most series 1AA, 1BB, and 1CC I.S.O. freight containers, or to a standard "high cube" shipping container.

2. Discussion Of the Prior Art

Pre-fabricated, foldable, portable building structures have been developed to enable shipment of structures in a collapsed form while facilitating the erection of those buildings. One objective in developing pre-fabricated, foldable, portable buildings is to provide for maximum square footage of erected structure while retaining a minimum volume of the structure in its collapsed form for shipping purposes. This avoids the unnecessary transportation of air volume within the structure, resulting in more economical transportation of such structures. At the same time, hingedly joining components of the structure to fold when collapsed facilitates erection of these structures at the erection site by unskilled labour at considerable cost and time saving.

The successful development and introduction of containerized transportation, involving the loading of fixed dimension containers aboard land, sea, and air modes of transportation specially adapted for standard container sizes, has provided considerable cost benefit and generally provides safer and quicker world wide freight transportation. The I.S.O. freight containers have been universally adopted by most modern modes of transportation, and practically every country in the world is now capable of handling and delivering such containers, making it possible to ship I.S.O. freight containers to practically any destination in the world.

Given the benefits associated with containerized transportation, the development of a pre-fabricated, foldable, portable building which is collapsible to fit within the outside dimensions of shipping containers meeting I.S.O standards is desirable. However, one problem associated with the development of a pre-fabricated, foldable, portable building which is collapsible to fit within the outside dimensions of an I.S.O. shipping container is the fact that the most popular I.S.O. shipping containers have an overall height of approximately eight and one-half feet. At the same time, it is desirable to provide an erected portable building having an interior ceiling height of at least seven and one-half feet from the floor, dictated by basic anthropometric and related construction standards. The difficulty arises with the inclusion of a sloping roof to such a building. In order to accommodate trusses which support a sloping roof of desired pitch in a building having a ceiling height of at least seven and one-half feet and a floor assembly thickness of at least six inches, an overall height in excess of eight and one-half feet must be accommodated, thereby exceeding standard I.S.O. container height. The distance between the ceiling and the peak of the roof extends the height substantially greater than eight and one-half feet and thereby greater than the maximum height dimensions of a standard shipping container.

A portable building having a sloping roof with extending roof trusses is disclosed in U.S. Pat. No. 3,348,344 of L. Tatevossian. The Tatevossian building provides for a rigid central roof extension above the ceiling to accommodate the trusses to support a sloping roof. If the ceiling height of the structure is at least seven and one-half feet, the upwardly extending trusses and floor thickness will make the height of the collapsed building substantially greater than the eight and one-half foot maximum height of an ISO shipping container. The apex of the upwardly extending trusses form the upper edge of the main support. This upper edge is substantially higher than the upper edges of the side wall panels which support the ceiling panels.

Accordingly, there exists a need for a pre-fabricated, foldable, portable building which, in its collapsed, folded position, is of an external shape, dimension and is appropriately configured to be compatible with series 1AA, 1BB and 1CC ISO freight containers, or to standard "high cube" shipping containers. This permits transportation and freight handling by almost every modern intermodal mode of freight transportation, to any destination, at a reasonable cost. At the same time, the foldable nature of such buildings permits ease of assembly at the site in a short time, with conventional, manually operated tools, without the need for skilled labour or heavy equipment. Because the building structure makes up most of the walls and the floor of the collapsed container-sized building, after installation, there is little or no residual waste materials or packaging and no returnable components or containers, which further significantly reduces transportation and handling costs and load on the environment.

SUMMARY OF THE INVENTION

The present invention provides a pre-fabricated, foldable, portable building which, when in a collapsed, folded condition, has an external shape and dimensions to fit within an envelope of an internationally standardised goods container. In particular, the invention, when folded, is appropriately configured to be compatible with storage and handling characteristics of series 1AA, 1BB, and 1CC ISO, or standard "High Cube" shipping containers. Thus, when the invention is folded there are significant cost reductions in transportation and handling, which can be effected by almost any modern mode of freight transportation..Because the collapsed building is easily transportable it can be made efficiently using modern mass production methods in a factory. In addition, structural parts are located to reduce waste of space within the envelope of the container so that most utility accessories found in a conventional house can be shipped within the container when in its collapsed state. When the container has been positioned and levelled on the site, the building can be erected quickly and easily, using a small number of unskilled workers on site. It is noted that the resulting erected building has a sloped roof for shedding precipitation, and a ceiling height of at least seven and one half feet, so that living space within the building is not unduly compromised by fitting within a conventional container.

A foldable portable building according to the invention comprises, when erected, a main support, a plurality of generally horizontal and planar hingedly interconnected floor sections, a plurality of generally horizontal and planar hingedly interconnected roof sections, and a plurality of generally vertical, hingedly interconnected wall sections. The main support comprises a main floor section, a main wall section and a main roof section, the wall section being supported on the main floor section and supporting the main roof section, the sections being rigidly interconnected. The floor sections include a first floor section hingedly interconnected to the main floor section. The roof sections are spaced above the floor sections and include a first roof section hingedly interconnected to the main roof section. The wall sections comprise at least one transversely disposed end wall section, two first wall sections and two second wall sections, the first and second wall sections being disposed adjacent opposite ends of the floor sections. The first and second wall sections have adjacent side edges hingedly connected to each other, and opposite side edges hingedly connected to the main- wall section and to the end wall section respectively similarly to a bellows. At least one of the first, second or end wall sections are supported and guided by the floor sections as the wall sections move between retracted and extended positions thereof. Upper edges of the wall sections are generally coplanar to each other to support thereon the roof sections extending therebetween. The upper edges of the wall sections are generally co-planer with a lower surface of the main roof section of the main support.

The roof sections further comprise at least one base ceiling member supported by the wall sections, a pair of outer roof members, and a plurality of trusses. Each outer roof member is hingedly connected to an opposite end edge of the base ceiling member for rotation of the outer roof members about respective axes of rotation relative to the said base ceiling member. The trusses are disposed parallel to each other to extend generally across the base ceiling member from the opposite edges thereof. The trusses are hinged for rotation relative to the base ceiling member to permit rotation of the trusses from retracted positions thereof in which the trusses lie generally parallel and adjacent to the base ceiling member, to extended positions thereof in which the trusses extend vertically from the base ceiling member. Each truss has a sloping top chord reaching an apex, wherein the trusses lie generally horizontally between the outer roof members and the base ceiling member when in the retracted position, and wherein the outer roof members rest on the top chords of the trusses when the trusses are in the extended positions thereof.

Preferably, the main wall section comprises a pair of spaced opposed central wall sections, and the lower surface of the main roof section extends perpendicularly from the central wall sections. Also, the main roof section is disposed above the main floor section and is supported by the central wall sections and is co-planar with the plurality of roof sections, the main roof section having a first side edge hingedly connected to the first roof section. Also, the main roof section has a second side edge disposed oppositely to the first side edge and hingedly connected to an additional first roof section of the plurality of roof sections on an opposite side of said building from the first roof section.

A foldable roof system according to the invention can be erected from a retracted position thereof, and the system comprises a base ceiling member, a plurality of trusses, and an outer roof member. The base ceiling member is adapted to be supported generally horizontally and has an edge. The trusses are disposed parallel to each other to extend generally across the base ceiling member from the said edge thereof. The trusses are hinged for rotation relative to the base ceiling member to permit rotation of the trusses from retracted positions thereof in which the trusses lie generally parallel and adjacent to the base ceiling member, to extended positions thereof in which the trusses extend upwardly from the base ceiling member. Each truss has at least one sloping top chord. The outer roof member has a proximal portion hingedly connected to the said edge of the base ceiling member so that when the roof system is retracted, the outer roof member is generally parallel to the base ceiling panel and the trusses are in the retracted positions thereof and interposed between the outer roof member and the base ceiling member. When the roof system is erected, the trusses are rotated to the extended positions thereof, and the outer roof member is rotated to be supported by the sloping top chords of the trusses so as to be inclined at an angle to the base ceiling member.

A foldable roof system according to the invention can be erected from a retracted position thereof and comprises a plurality of interconnected base ceiling members, a plurality of trusses, and a plurality of pairs of outer roof members. The base ceiling members are supportable generally horizontally and have respective oppositely located edges. The trusses are hingedly connected to each base ceiling member, the trusses being disposed parallel to each other to extend generally across the respective base ceiling member between the respective edges thereof. The trusses are hinged for rotation relative to the respective base ceiling member to permit rotation of the trusses from retracted positions thereof in which the trusses lie generally parallel and adjacent to the respective base ceiling member, to extended positions thereof in which the trusses extend upwardly from the respective base ceiling member. Each truss has at least one sloping top chord. Each pair of outer roof members has proximal portions hingedly connected to opposite edges of the respective base ceiling member, so that when the roof system is retracted, the outer roof members are generally parallel to the respective base ceiling member, and the trusses are in retracted positions thereof and interposed between the roof members and the respective base ceiling members, and distal portions of each pair of outer roof members overlap each other. When the roof system is erected, the trusses are rotated to the extended positions thereof and the outer roof members of a particular pair of outer roof members are rotated to be supported by the sloping top chords of the trusses so as to be inclined at respective angles to the respective base ceiling members, with the distal portions of each pair of outer roof member being generally adjacent each other at an uppermost position of the roof.

A foldable portable building according to the invention comprises, when folded, a main support, a plurality of generally vertical, hingedly interconnected roof sections, a plurality of generally vertical, hingedly interconnected wall sections, and plurality of generally vertical, hingedly interconnected roof sections. The main support comprises a main floor section, a main wall section and a main roof section, the main wall section being supported on the main floor section and supporting the main roof section. The sections are rigidly interconnected and the main floor section defines a bottom of a parallelepiped box-like container. The floor sections include a first floor section hingedly interconnected to the main floor section and extending vertically from the main floor section to define one side of the box-like container, the side being essentially unobstructed. The wall sections comprise at least one transversely disposed end wall section, two first wall sections and two second wall sections. The first and second wall sections have adjacent side edges hingedly connected to each other and opposite side edges hingedly connected to the main wall section and to the end wall section respectively similarly to a bellows. The first, second and end wall sections have upper and lower edges closely adjacent the main roof section and the main floor section respectively, and the first wall sections are closely adjacent the main wall section. The roof sections include a first roof section hingedly interconnected to the main roof section. The plurality of roof sections are located on a side of the plurality of wall sections remote from the main wall section so that the plurality of roof sections are interposed between the wall sections and the floor sections.

A detailed disclosure following, related to drawings, describes a preferred embodiment of the invention which is capable of expression in structure other than that particularly described and illustrated.

DESCRIPTION OF THE PREFERRED EMBODIMENTS

Figure 1:
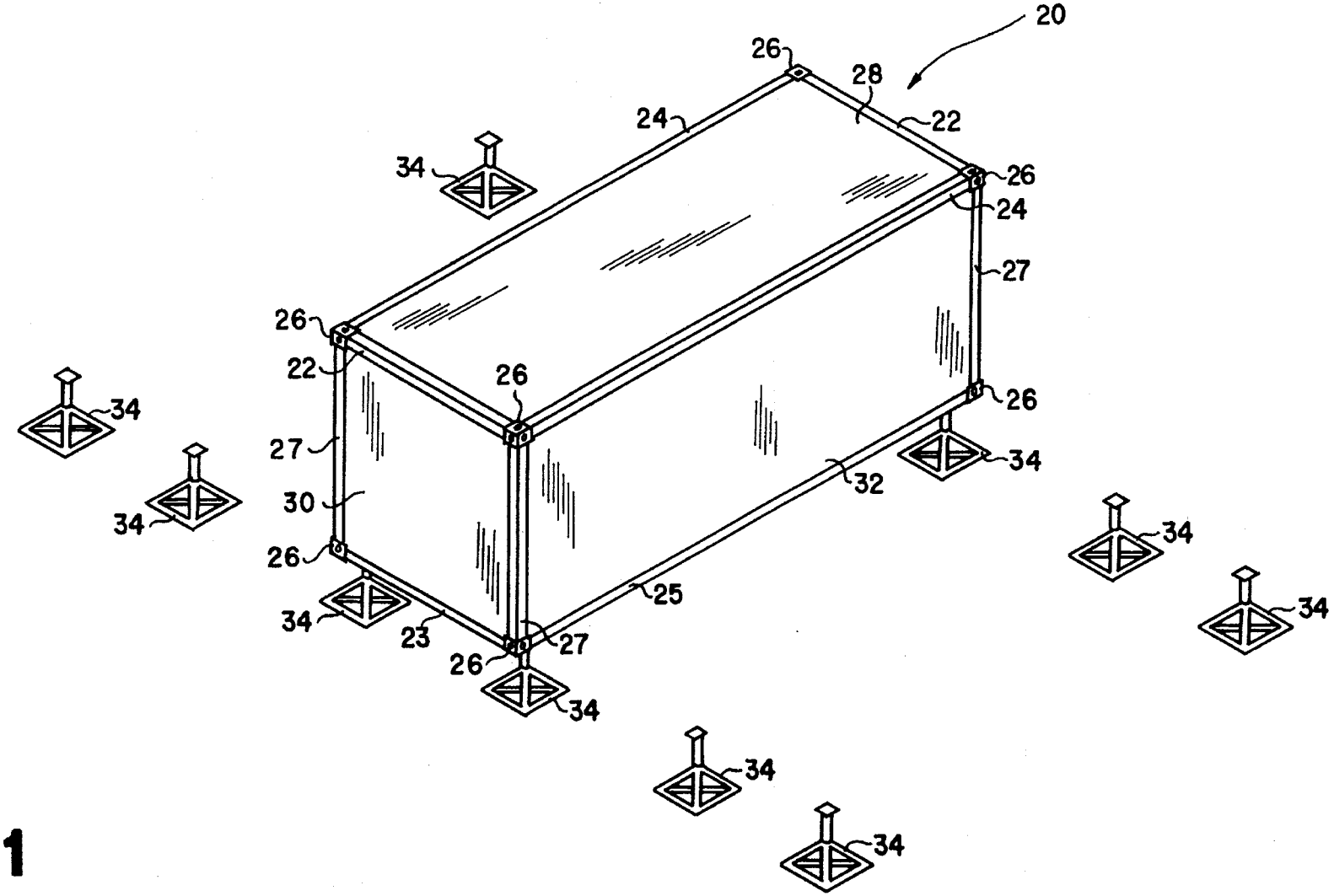
FIG. 1 is a perspective view of a fully collapsed container-sized foldable portable building of the present invention with the support piers positioned for supporting the expanded building.

Referring to FIG. 1 of the drawings, there is shown generally a foldable portable building 20 in its packed, non-erected state. Building 20 defines a parallelepiped shape of a size equivalent to the size of an I.S.O. type 1AA, 1BB, 1CC freight container or standard "high cube" shipping container having generally the following standard overall dimensions:

| | Length ft. in. | Width ft. in. | Height ft. in. |
|---|---|---|---|
| 1AA | 40 0 | 8 0 | 8 6 |
| 1BB | 29 11¼ | 8 0 | 8 6 |
| 1CC | 19 10½ | 8 0 | 8 6 |
| high cube | 40 0 | 8 0 | 9 0 |
| | 40 0 | 8 0 | 9 6 |

Building 20, in its retracted or folded state, is reinforced at its edges by two top end edge supports 22, two top side edge supports 24, two bottom end edge supports 23 and two bottom side edge supports 25. Supports 22, 23, 24 and 25 are bolt connected to comer fitting connectors 26 shown in detail in FIG. 16, positioned in accordance with standard container specifications for use in carrying and facilitating loading and unloading of the container-sized collapsed building 20.

Figure 16:
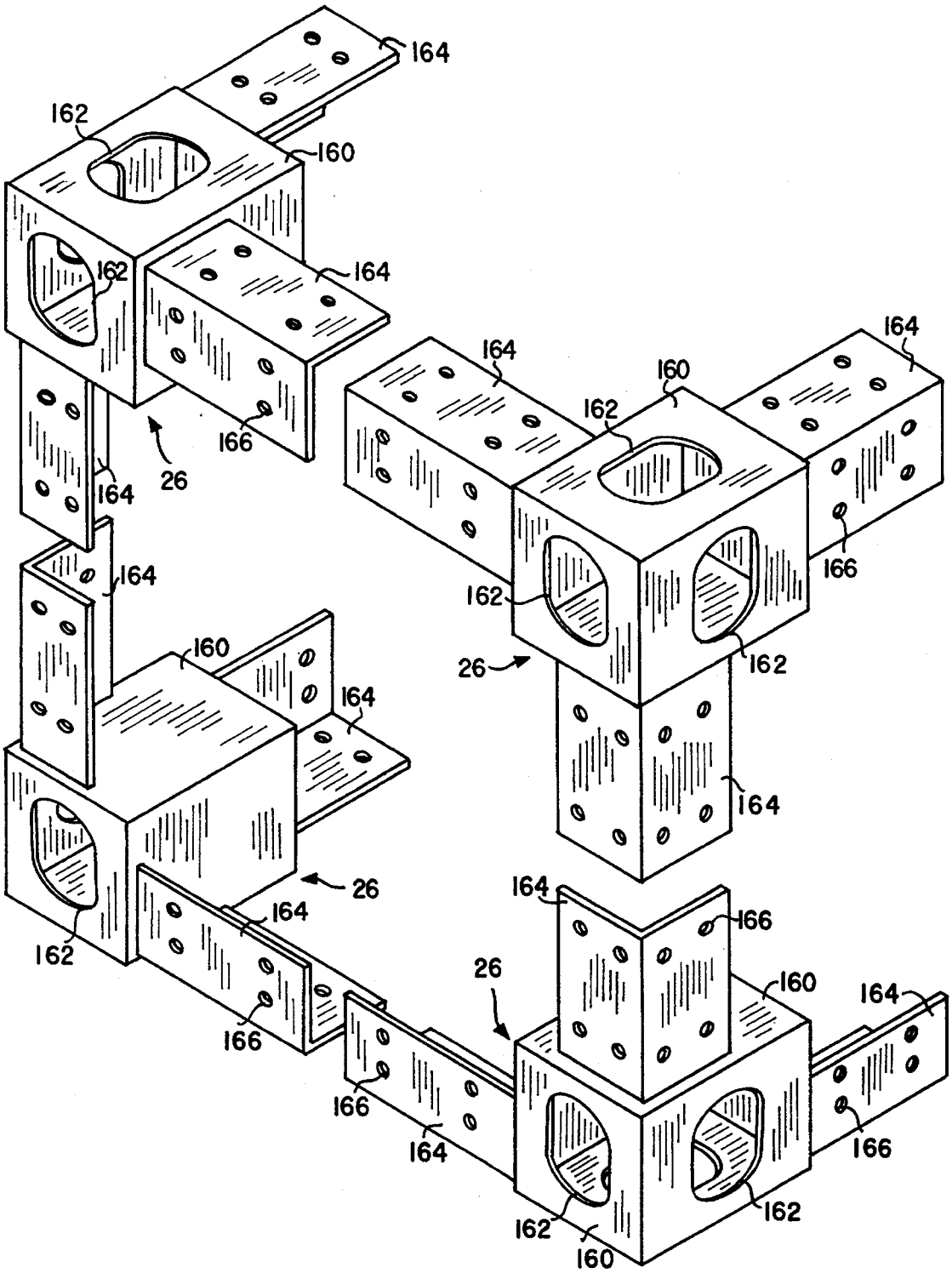
FIG. 16 is a close-up perspective view of the comer fitting connectors of the building of FIG. 1.

Referring to FIG. 16, comer fitting connectors 26 include corner fitting 160 with openings 162 which are dimensioned and positioned to permit insertion of forklift tines, and the like, in order to permit lifting of building 20 by suitable equipment used to transport, load and unload containers. Corner fitting connector 26 includes three angled members 164 extending therefrom in a manner to form corners of collapse building 20. Angled members 164 include a plurality of bolt openings 166 to accept bolts (not shown) therethrough for interconnection with adjacent top end edge supports 22 and top side edge supports 24, and as well adjacent bottom end edge supports 23 and bottom side edge supports 25. In this way corner fittings connector 26, are rigidly connected to supports 22, 23, 24 and 25 to form a rigid frame about collapsed building 20 to provide protection and to permit handling of building 20 in the same manner as a standard I.S.O. or "high cube" shipping container.

When collapsed, building 20 includes reinforced top face or cover 28, reinforced bottom face (not shown), a pair of opposed reinforced end faces or covers 30, and a pair of opposed side faces 32 the covers 28 and 30 and the faces 32, as well as the bottom face, act to contain the contents of building 20 and act to protect the contents during shipping. In addition, as will be discussed below, faces 32 and the bottom face, are a part of the integral structure of the building 20 and unfold as a part of the erection process. As can be appreciated, the folded building 20, when in its unerected state as depicted in FIG. 1, may be transported anywhere, and by any means, suitable for container transportation.

Container-sized building 20 will usually arrive at the building erection site by means of land vehicle transportation, such as a flat bed truck or a truck equipped for transporting containers. Building 20 is taken off of the vehicle as one unitary block by any suitable means appropriate to movement of containers. While building 20 may be erected on a concrete pad or other foundation base, including earth or gravel, it is preferred, in order to facilitate levelling of the floor and to simplify the foundation work, to erect building 20 on a plurality of adjustable screw jacks or piers 34. Preferably, four of the piers 34 are placed at the four lower comers of the collapsed containerized building 20. A pair of piers 34 is placed outwardly in the direction of the hinging extension of the floor generally positioned at the ends of the outer edge of the first floor member. A second pair of piers 34 are positioned outwardly from the first pair of piers 34 at the ends of the outer edge of the second floor member. Similarly, on the other side of containerized building 20, a further set of four piers are positioned to support the expanded first and second floor sections. Containerized building 20 is placed on the four central piers 34 positioned at the four corners of the containerized building 20.

Figure 6:
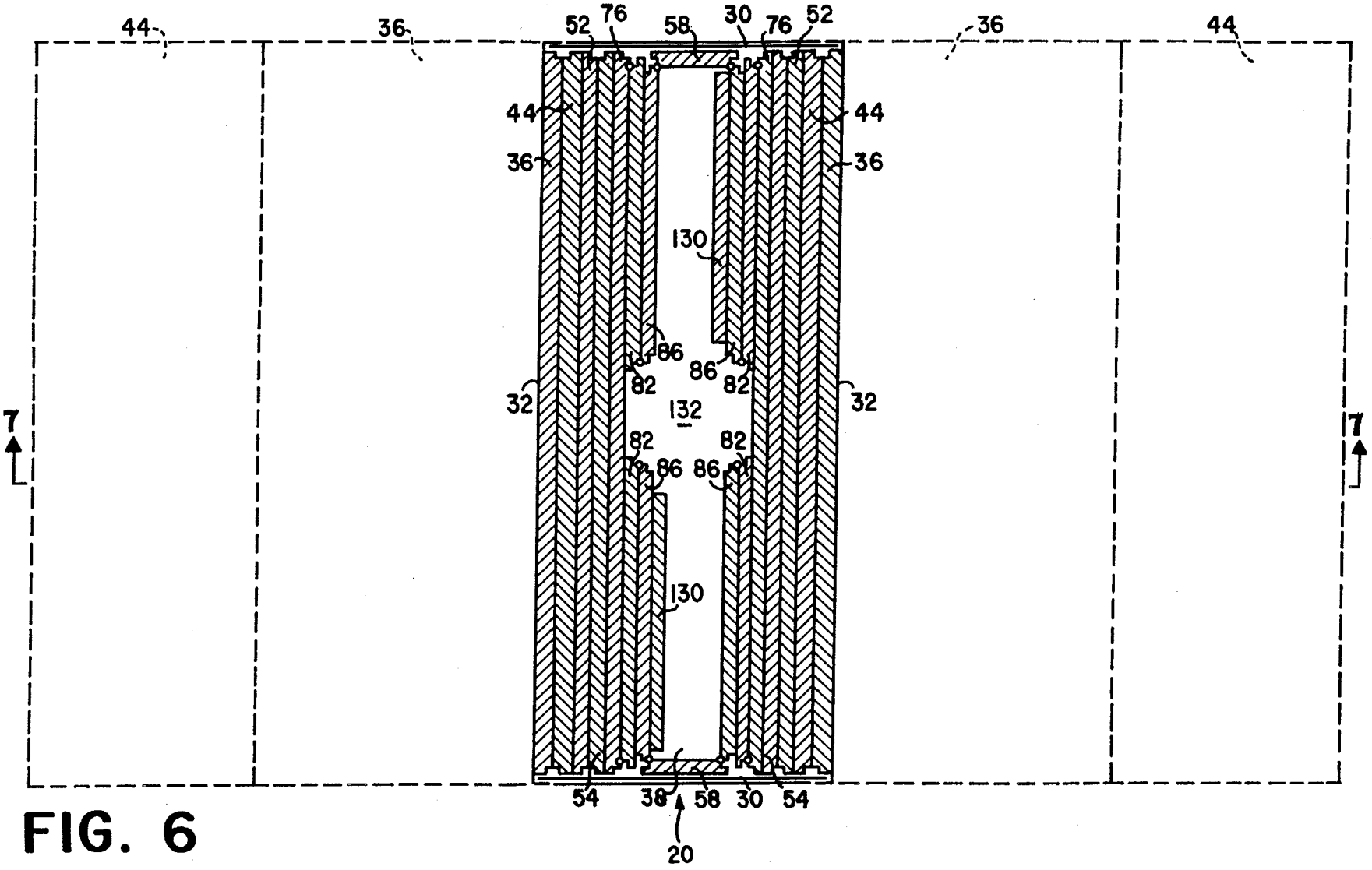
FIG. 6 a top schematic plan view of the building of FIG. 1 in its fully collapsed position to fit within the dimensions of a standard container.
Figure 7:
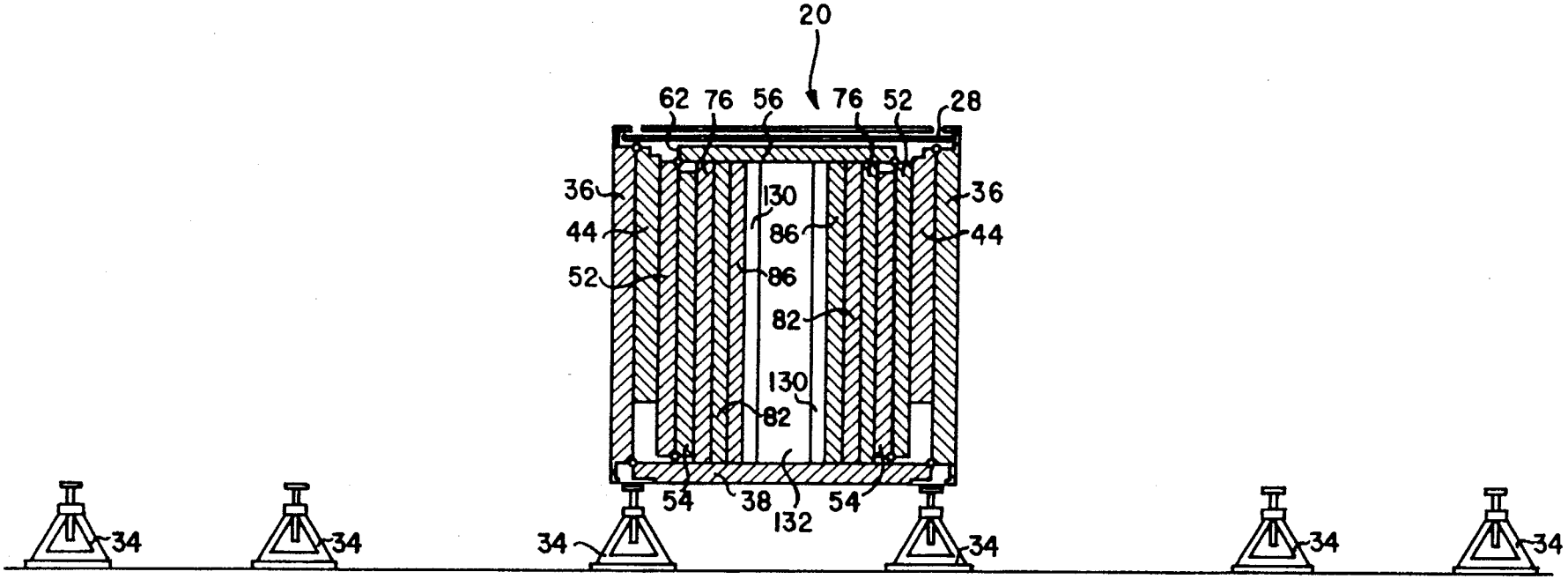
FIG. 7 is a side schematic view taken along line 7—7 of FIG. 6.

Referring to FIGS. 6 and 7, the fully collapsed portable building 20 is shown in top and side views with temporary end faces 30 defining the outer ends of the containerized building 20. Side faces 32 of first floor section 36 define the outer sides of the containerized building 20. First floor sections 36 are oriented vertically and disposed outwardly of edges of the main floor section 38 and the main roof section 56 (as seen best in FIG. 7A).

In order to erect building 20, top and bottom comer fitting connectors 26 are removed. Top edge supports 22 remain on building 20 temporarily, to facilitate a safe and orderly erection process.

Figure 2:
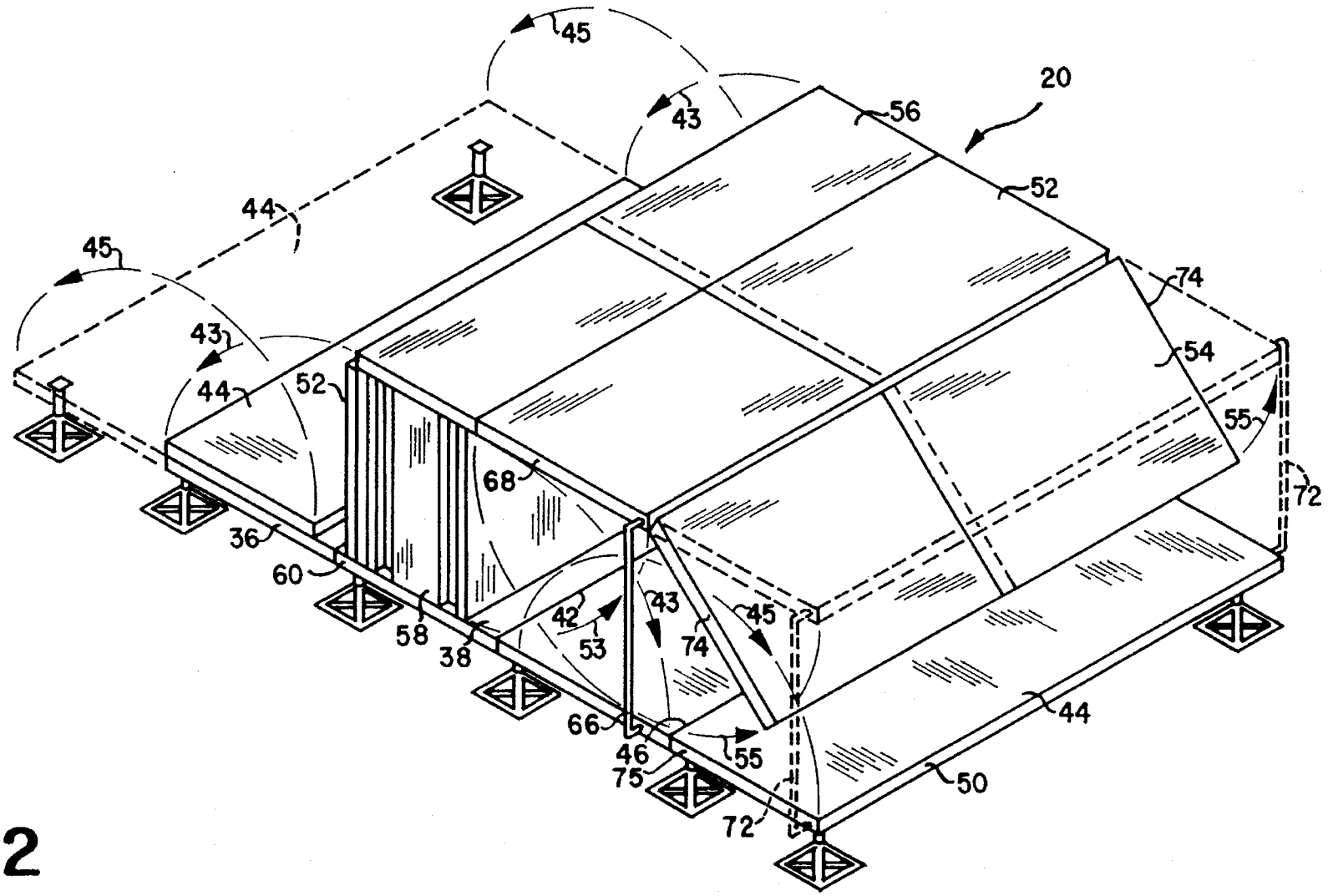
FIG. 2 is a perspective view of the building of FIG. 1 with the ceiling and floor panels partially expanded.
Figure 3:
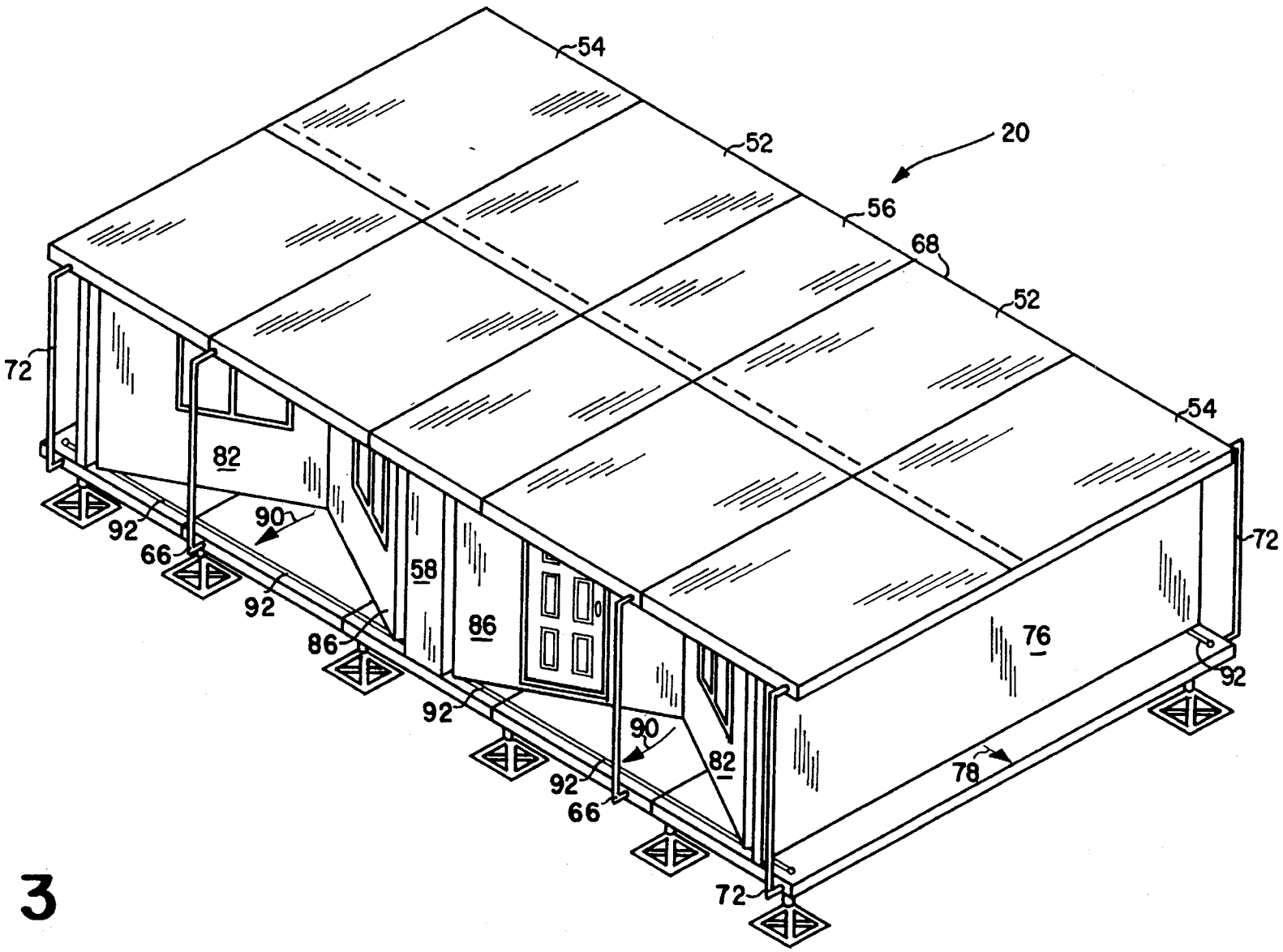
FIG. 3 is a perspective view of the building of FIG. 1 with the floor and ceiling panels expanded and the wall panels partially expanded.
Figure 8:
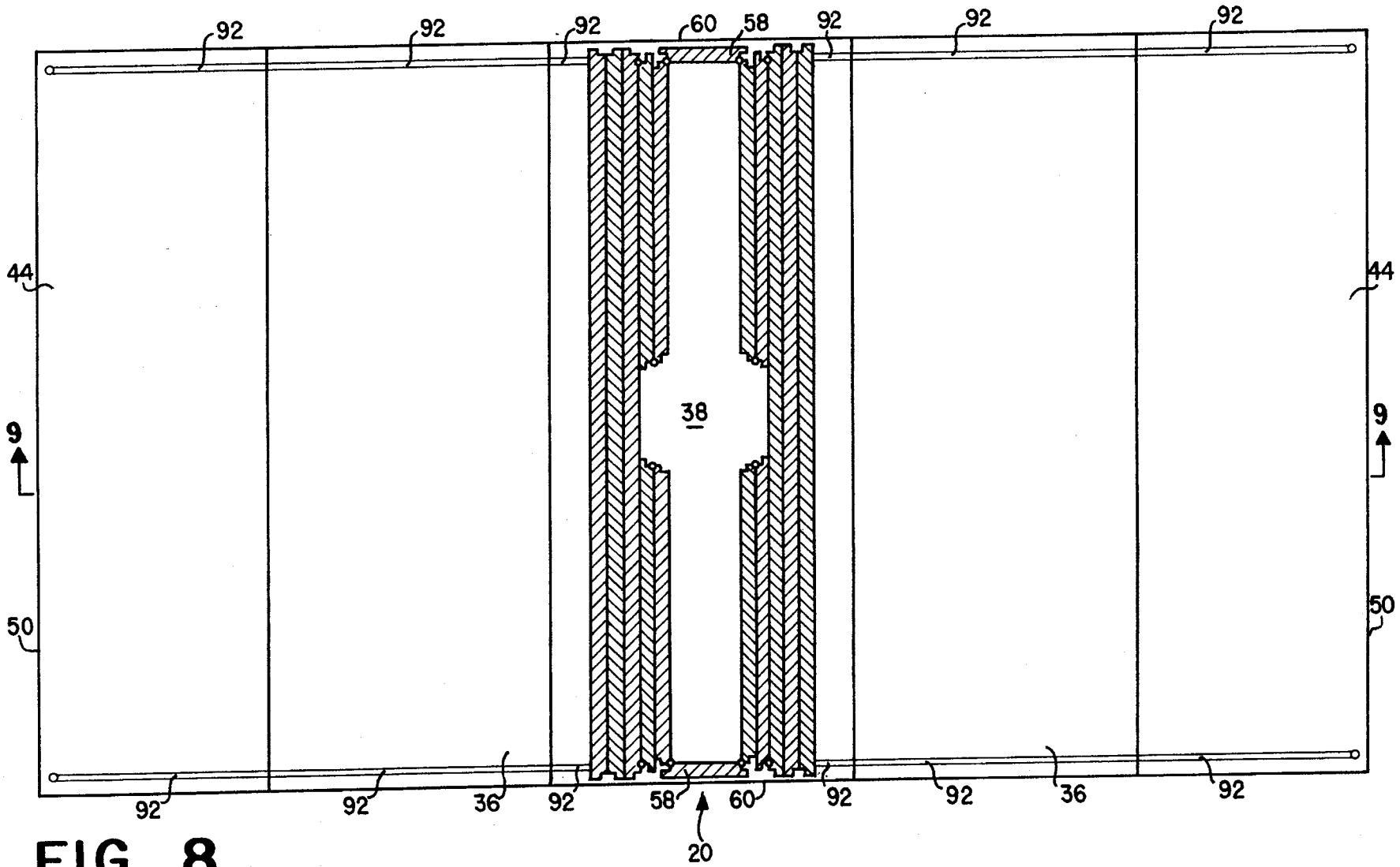
FIG. 8 is a top schematic view of the building of FIG. 1 with all the floor panels erected.
Figure 9:
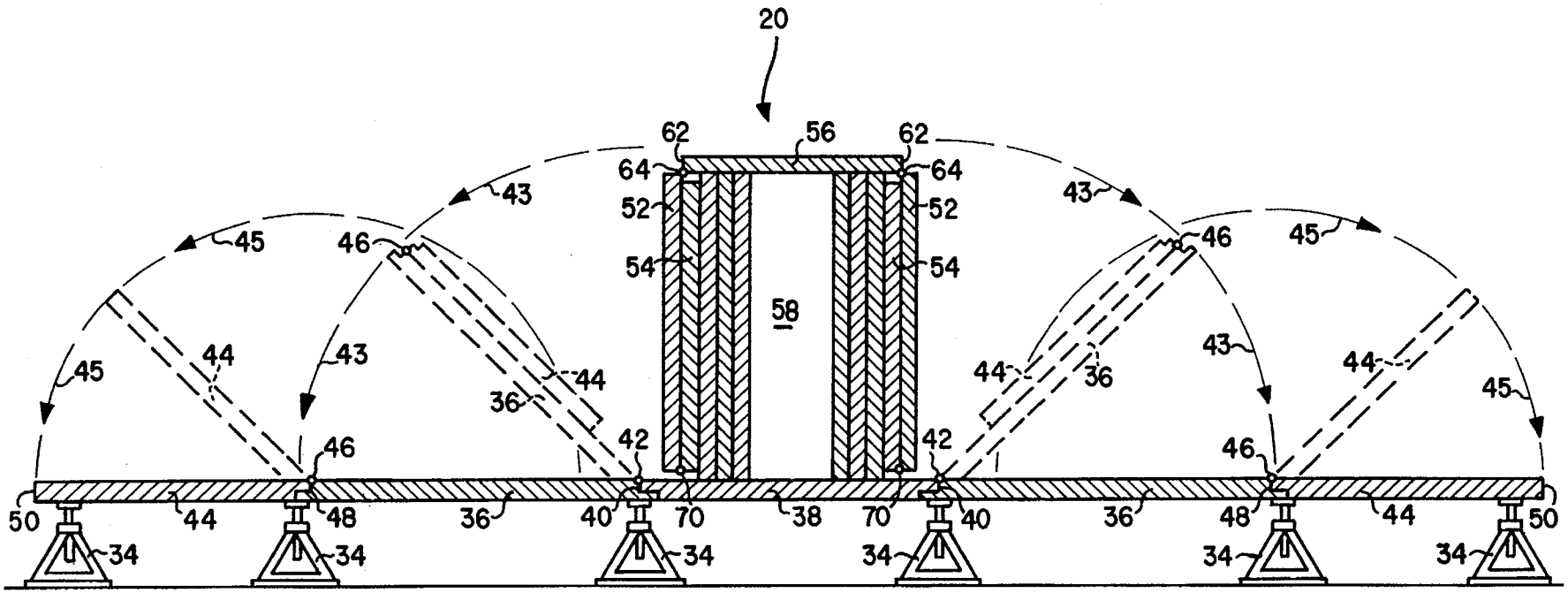
FIG. 9 is a side schematic view taken along line 9—9 of FIG. 8.

Referring to FIGS. 2, 8 and 9, each first floor section 36 is hingedly connected to the side edges 40 of main floor section 38 at hinges 42. Side face 32, which defines the outer side wall of the collapsed building 20, forms the lower face of the first floor section 36. First floor section 36 is moved to its erected position by rotating section 36 through an angle of 90°, from a vertical position to a horizontal position, about hinge 42 in the direction of arrow 43, to rest in the same plane as the main floor section 38. Second floor section 44 is hingedly connected to the adjacent first floor section 36 by hinge 46. Second floor section 44 rotates from a vertical, collapsed position to a horizontal position on movement of first floor section 36 about hinge 42 to its horizontal erected position. Once the first floor section 36 has been lowered, its outer edge 48 rests on a pair of piers 34 positioned at the ends of outer edge 48.

Second floor section 44 is then rotated about hinge 46 in the direction of arrow 45 through an angle of 180° to a horizontal position extending laterally, and in the same plane as, first floor section 36. The ends of outer edge 50 of second floor section 44 rest on a pair of outer piers positioned generally adjacent the ends of edge 50. These steps are repeated on the other side of main floor section 38 with an equivalent set of first and second floor sections 36 and 44 to completely unfold and erect the floor sections 36 and 44 on each side of main floor section 38. Thus, when erected, the building has a floor comprised of a plurality of generally horizontal and planar, i.e. within a plane, hingedly interconnected floor sections.

Figure 10:
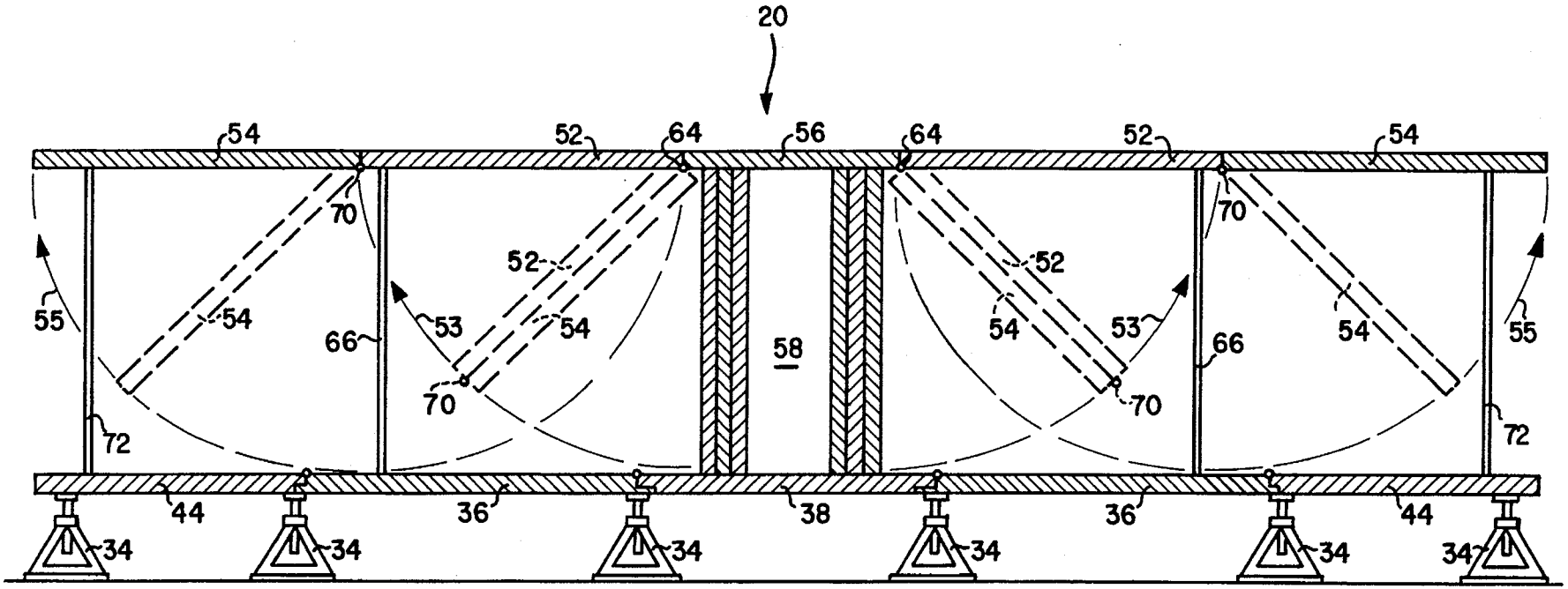
FIG. 10 is a side schematic view of the building of FIG. 1 showing the ceiling panels fully erected.

Referring to FIGS. 2 and 10, erection of the roof sections will now be discussed. As can be seen in FIG. 10, first roof section 52 and second roof section 54 are initially suspended vertically from main roof section 56. First and second roof sections 52 and 54 are retained in position when building 20 is in its collapsed state by floor sections 36 and 44 (see FIG. 7). Main roof section 56 is, in turn, supported by a pair of opposed main central wall sections 58 which are attached to main floor section 38 adjacent the end edges 60 (FIG. 8) of main floor section 38. Main roof section 56, the two central wall sections 58 and the main floor section 38 form a main support and rigid central structure. The side edges 62 (FIG. 9) of main roof section 56 are hingedly attached to first roof section 52 by means of hinges 64 provided at a lower corner of main roof section 56. First roof section 52 is supported by the main roof section by means of hinge 64. Main roof section 56 is supported by central wall sections 58 within a generally horizontal plane spaced above main floor section 38.

To erect the roof of the building 20, first roof section 52 is rotated in the direction of arrow 53 upwardly through 900 to a horizontal position about hinge 64 and is supported temporarily by C-shaped supports 66 inserted into openings in both end edges 68 of first roof section 52 and end edges of the floor section 36. Support 66 is C-shaped to avoid impinging on the hinging action of second roof section 54 and the expansion of the wall section. First roof section 52 is suspended horizontally in a spaced relationship above first floor section 36 in the same horizontal plane as the main roof section 56.

Second roof section 54 is then rotated in the direction of arrow 55 outwardly through 180° to a horizontal position by rotation about hinge 70. A second set of C-shaped temporary supports 72 are inserted into openings in end edges 74 (FIG. 2) of second roof section 54 and end edges 75 of the floor sections 44. Second roof section 54 is thereby supported and suspended above second floor section 44 by temporary supports 72. Supports 72 are C-shaped, as with supports 66, to avoid impinging on expansion of the wall sections to their erected positions. Second roof section 54 is suspended in the same horizontal plane as sections 56 and 52. Similarly, an opposite first roof section 52 and second roof section 54 extend from the other side edge of main roof section 56 and are unfolded into position in the same manner as the first set of first and second roof sections 52 and 54. Thus when erected the building has a plurality of generally horizontal and planar, hingedly interconnected roof sections spaced above the floor sections.

Figure 11:
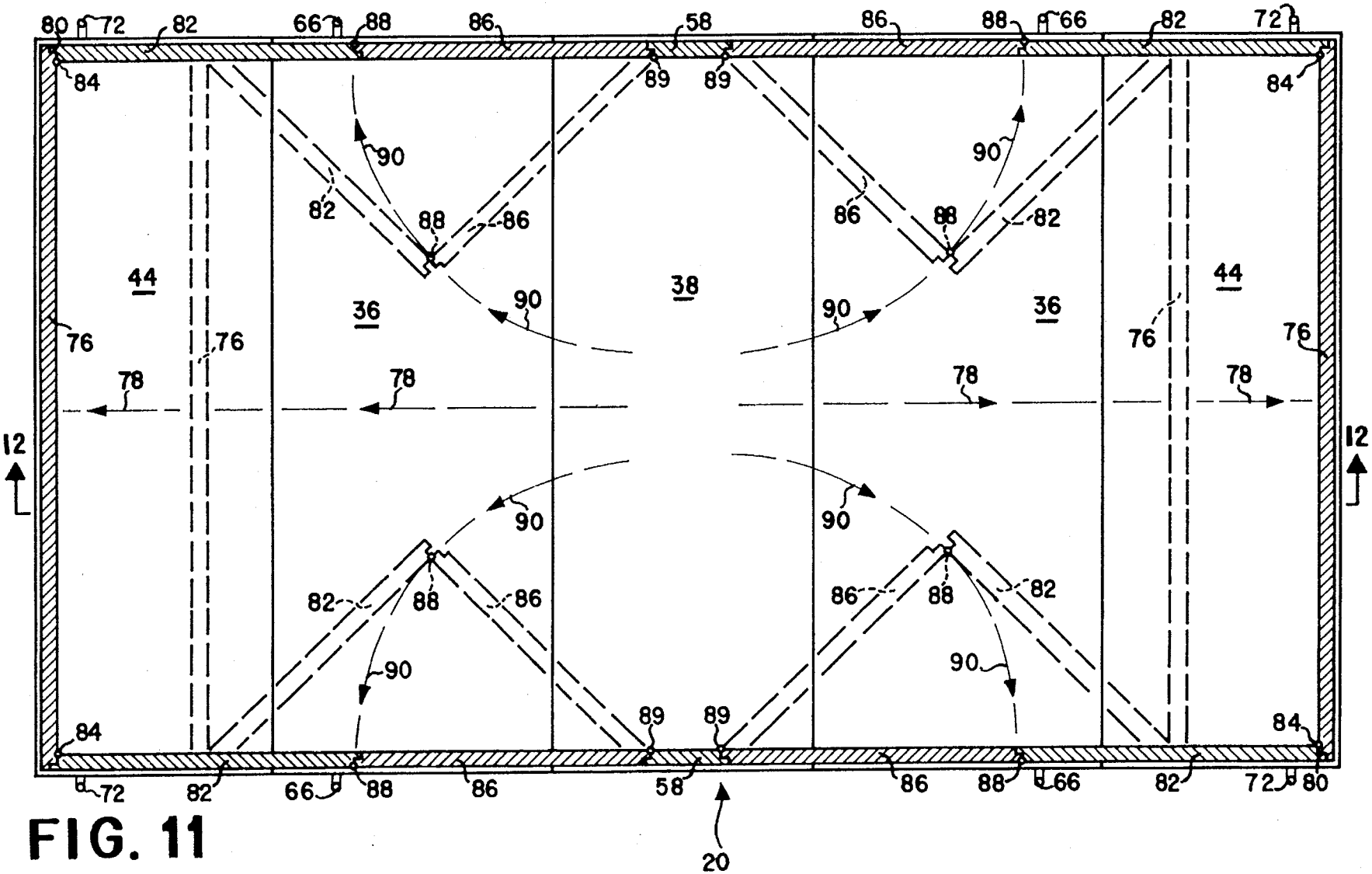
FIG. 11 is a top schematic view of the building of FIG. 1 with bellows-type walls fully extended.

Referring now to FIGS. 3, 6A, 11 and 12, the unfolding and erection of the walls of building 20 will be discussed. Referring initially to FIG. 11, the walls are extended by moving end wall section 76 outwardly from main floor section 38 in the direction of arrows 78. The end edges 80 of end wall section 76 are stepped and hingedly connected to the outer edge of second wall section 82 by means of hinges 84. First wall section 86 is, in turn, hingedly connected at its outer edge to second wall section 82 by means of hinge 88 and at its inner edge to wall section 58 by means of hinge 89. It can be seen that movement of end wall section 76 in the direction of arrows 78 will cause wall sections 82 and 86 to move from their retracted position above main floor section 38 and parallel with end wall section 76 to an extended position perpendicular to end wall section 76 and in the same vertical plane as central wall section 58. Movement of end wall section 76 in the direction of arrows 78 will move hinges 88 and the attached edges of sections 82 and 86 in the direction of arrows 90. When end wall section 76 is extended to its end position adjacent the outer edge 50 (FIG. 2), wall sections 82 and 86 will be oriented in vertical alignment in the same vertical plane to form linear vertical walls along the end edges of floor sections 36, 38 and 44. Temporary supports 66 and 72, holding roof sections 52 and 54 above extended wall sections 82 and 86, may then be removed and the roof sections 52 and 54 are then supported by wall sections 76, 82 and 86. Similarly, on the side opposite main floor section 38, wall sections 76, 82 and 86 may be extended and temporary supports 66 and 72 removed, to permit wall sections 76, 82 and 86 to support roof sections 52 and 54. See, in particular, FIG. 3, which depicts the bellows-like movement of wall sections 76, 82 and 86 on both sides of section 38 to the extended position.

In order to facilitate the bellows-like expansion of wall sections 76, 82 and 86 between the retracted and expanded positions of the wall sections, a pair of parallel spaced linear aligned grooves 92 are formed adjacent and parallel to the end edges of floor sections 38, 36 and 44 (FIGS. 3 and 8) i.e. perpendicularly to the side edges of the said floor sections. As seen in close-up in FIG. 15, grooves 92 guide wall sections by means of downwardly extending ball guiding member 94 extending downwardly from the lower face of end wall section 76 adjacent the outer edge of wall sections 76.

Figure 6A:
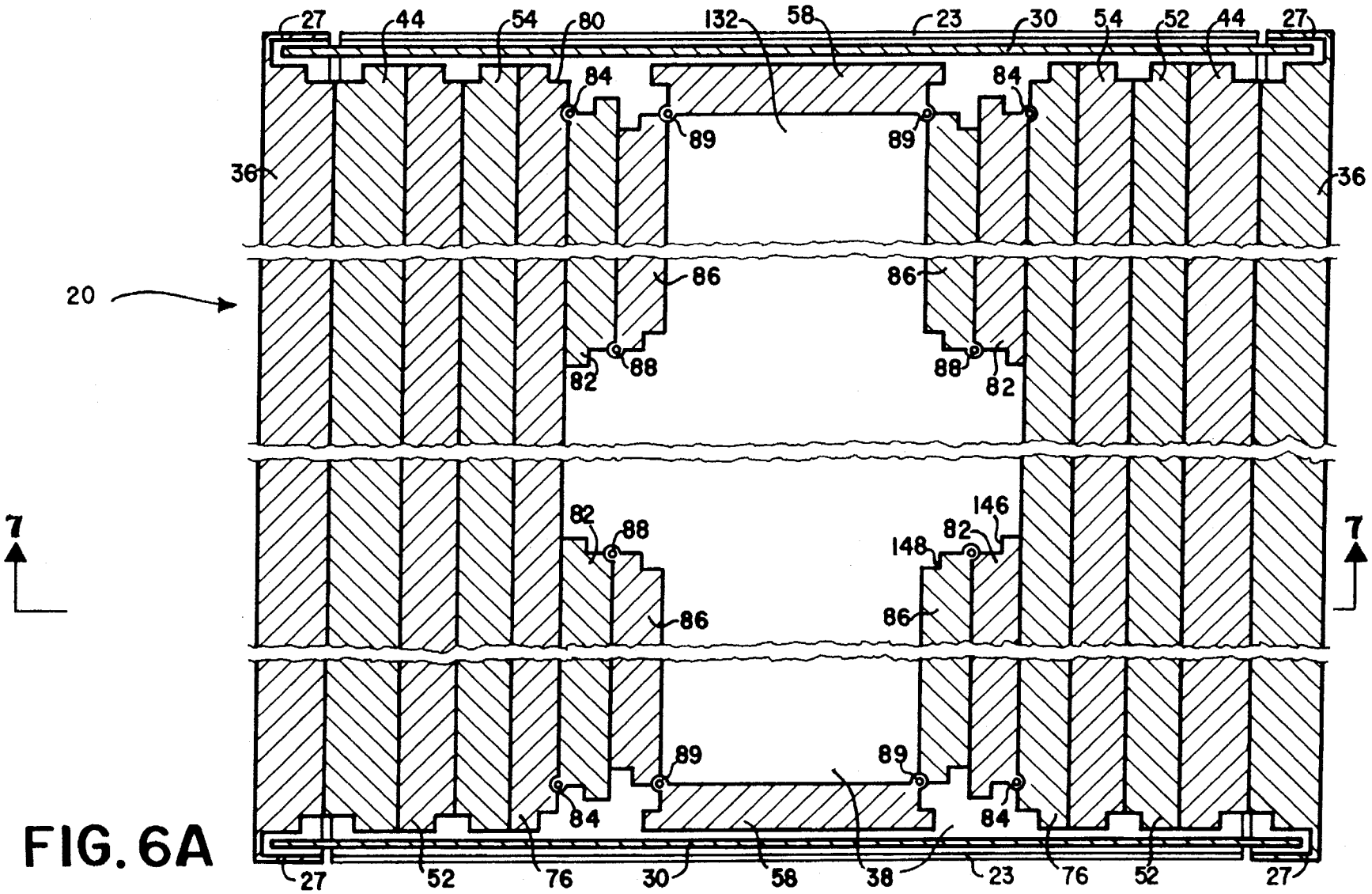
FIG. 6A is a close-up view of FIG. 6.

Referring to FIG. 6A, the adjacent edges of wall sections 86 and 82 are shown connected by hinge 88. In order to provide a weather-resistant seal, inner edges 146 and 148 are generally L-shaped to provide an off-set abutting edge to minimize seepage of water and other foreign material through the adjacent inner edges into the erected dwelling. To further facilitate the sealing engagement of adjacent inner edges 146 and 148, an L-shaped gasket (not shown) is positioned along a portion of adjacent inner edge 146 of wall section 82. Flat gasket (not shown) is placed along a portion of the inner edge of 148 of wall section 86. When the wall sections are in the fully erected position, in co-planar alignment, a portion of gasket overlies in sealing relationship to form a fight weather-resistant seal between these L-shaped members. Preferably, the gasket members are of resilient rubber-like construction to assist in the sealing of adjacent inner edges 146 and 148 of wall sections 82 and 86, respectively. Similar gasket members are used in the sealing of the other wail edges.

In summary, it can be seen that an important feature of the building relates to the main support disposed centrally of the building and comprising the main floor section 38, the main roof section 56, and the two central wall sections 58 supported on the main floor section and supporting the main roof section. For convenience of terminology, particularly in the claims, the two central wall sections 58 are termed a main wall section. The sections of the main support are rigidly interconnected to provide a stable support from which all remaining structure can extend. In addition to the two similar groups of hingedly interconnected floor sections and roof sections which are generally horizontal and planar when the building is erected, and disposed vertically and stacked together when the building is collapsed, the invention also comprises two similar groups of generally vertical, hingedly interconnected wall sections. Similarly to the groups of floor sections and roof sections, one group of wall sections is located on each side of the main support to cooperate with corresponding first and second floor sections and roof sections on each side of the main support. The wall sections on one side of the main support comprise a transversely disposed end wall section 76, two first wall sections 86, and two second wall sections 82. The first and second wall sections are disposed adjacent opposite ends of the floor sections, and have adjacent side edges hingedly connected to each other and opposite side hingedly connected to the main wall section 58, and to the end wall section 76 respectively similarly to a bellows. At least one of the first, second or end wall sections are supported and guided by the floor sections as the wall sections move between retracted and extended positions thereof. In addition, upper edges of the wall sections are generally co-planar to each other to support thereon the roof sections extending therebetween. Clearly, the upper edges of the wall sections are generally co-planar with a lower surface of the main roof section of the main support.

For convenience of claim terminology, the specific roof section and floor section which are located on one side of the main support and directly hinged to the main roof section and the main floor section are termed "first roof section and first floor section" respectively, whereas the specific roof section and floor section which are located on the opposite side of the main support and directly hinged to the main roof section and the main floor section are termed "additional first roof section and additional first floor section" respectively.

The erection of the sloped roof will now be discussed with reference to FIGS. 4, 13, 14, and 15. Roof sections 52, 54 and 56 are made up of base ceiling member 96, trusses 98 and outer roof members 100. Trusses 98 are hingedly connected to base ceiling member 96 at truss hinges 102 which connect trusses 98 to ceiling joists 112. Trusses 98 are folded to lie flat against base ceiling member 96 when in the retracted position for shipping. When in the retracted positions, trusses 98 are sandwiched between base ceiling member 96 and the outer roof members 100; roof member 100 and base ceiling member 96 defining parallel planes. Proximal or lower portions of the outer roof members 100 are hingedly attached by hinges 101 to end beams 104 extending along end edges of the base ceiling member 96 for hinged rotational movement of roof members 100 about a roof member hinge axis parallel with the plane of the end edges of roof sections 52, 54 and 56. It can be seen that the roof member hinges are disposed perpendicularly to the truss hinges.

Following conventional practice, the outer roof members 100 are formed from this corrugated sheets, with parallel lines of corrugations extending normally to hinges of the outer roof members. To enable distal portions of the outer roof members on one side of the building to occupy minimum space when overlying distal portions of the outer roof members on the opposite side of the building when the outer roof members are collapsed and horizontal, the corrugations on one side of the building are "in phase" with those on the opposite side of the building.

Figure 4:
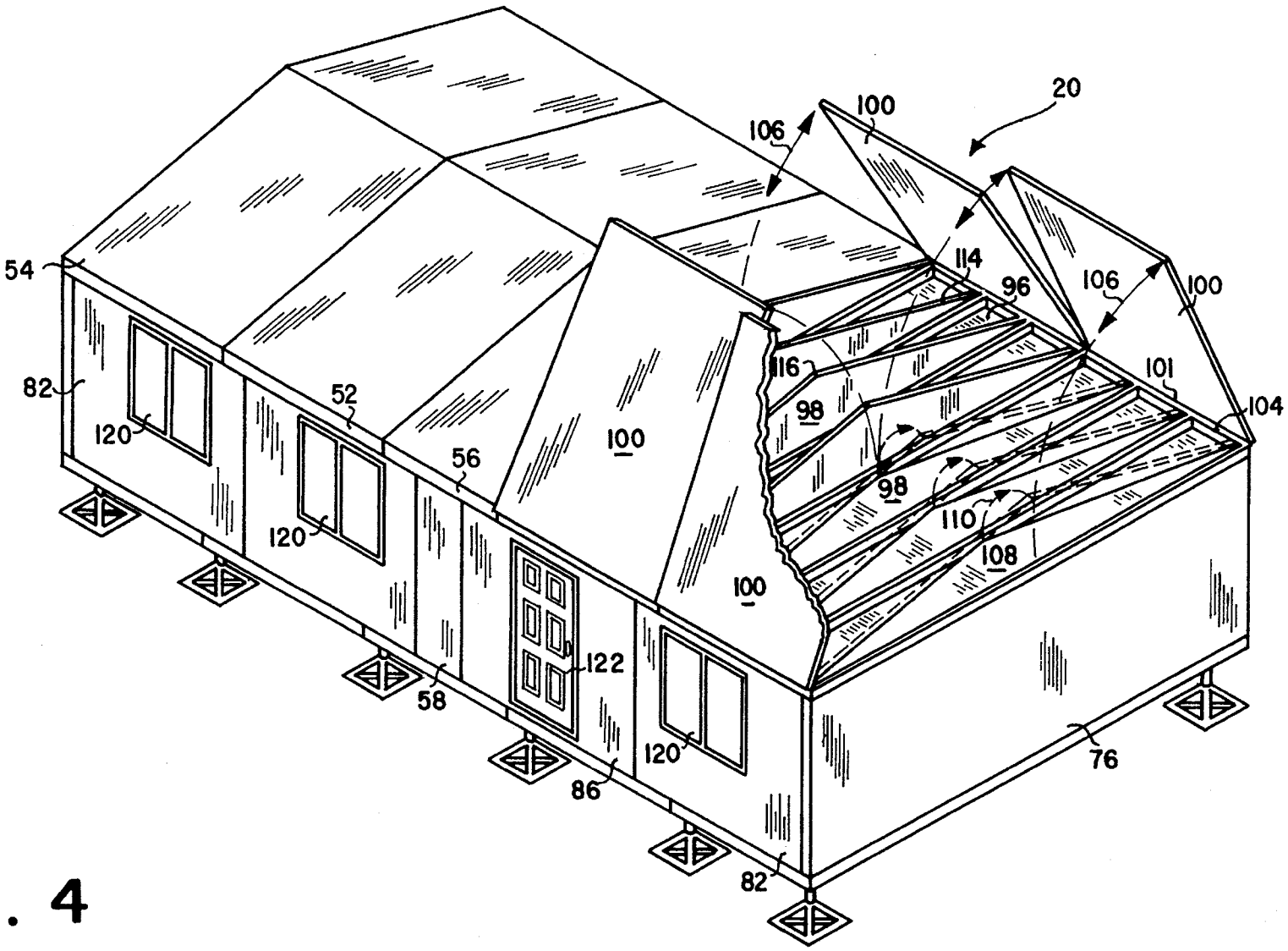
FIG. 4 is a perspective view of the building of FIG. 1 showing some of the collapsible roof trusses and roof panels hingedly connected to the base ceiling panel of the roof sections, to form a sloping roof.
Figure 13:
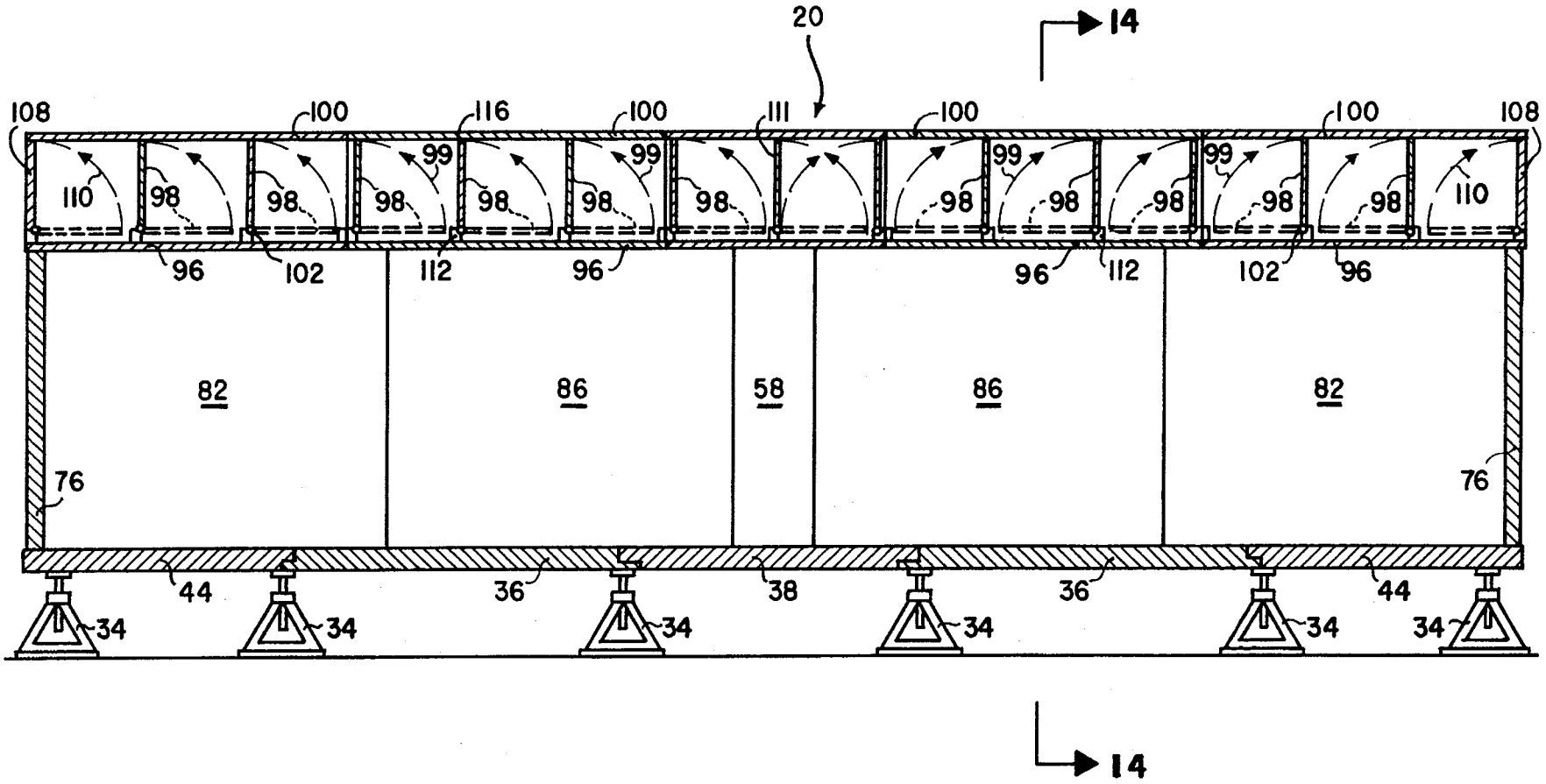
FIG. 13 is a side schematic view of the building of FIG. 1 showing roof truss members fully erected.

In order to erect the trusses and form a sloped roof for building 20, roof members 100 must first be rotated upwardly in the direction of arrows 106 about hinge 101. End gable 108, which is hingedly connected to the outer edge of the base ceiling member 96, is rotated in the direction of arrow 110 from a horizontal position to a vertical position as depicted in FIGS. 4 and 13. Trusses 98 are then rotated about hinges 102 (FIGS. 13 and 15) from the collapsed horizontal position through an angle of 90° to the erected vertical position in the direction of arrows 99. When in the vertical position, trusses 98 support ceiling joists 112 extending longitudinally along base ceiling member 96 between end edges of sections 52, 54 and 56. In their collapsed position, joists 112 provide support for trusses 98. Once all trusses 98 have been rotated to their vertical, erected position, roof members 100 may be lowered to rest on the top chords 114 of trusses 98. Because top chord 114 is sloped between apex 116 and end beams 104, roof sections will be likewise sloped away from apex 116 downwardly to the outer edges of roof sections 52, 54 and 56. This forms a sloped roof to facilitate drainage of water, snow and material failing on the outer roof members 100.

Figure 15:
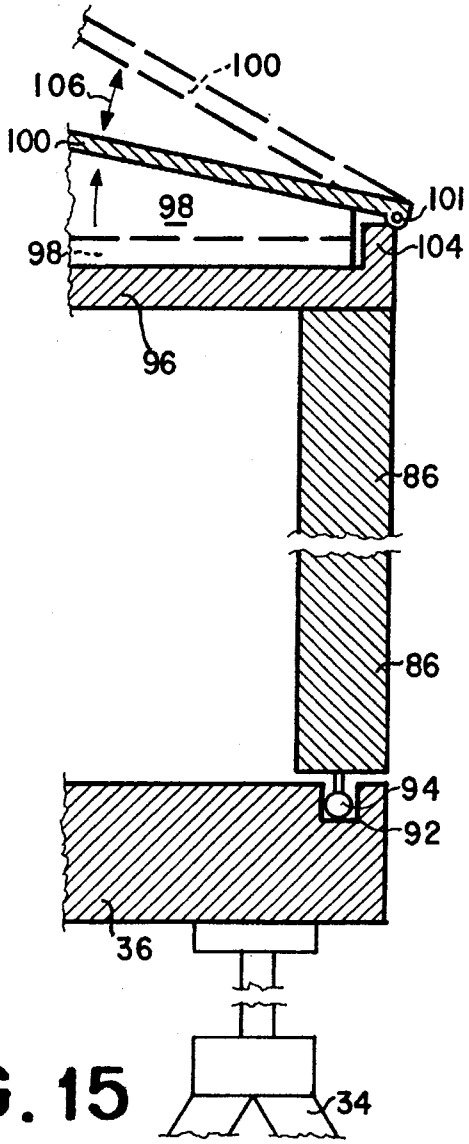
FIG. 15 is a close-up sectional view of the connection of the wall panels to the outer corner of the roof panel and floor panel.
Figure 14:
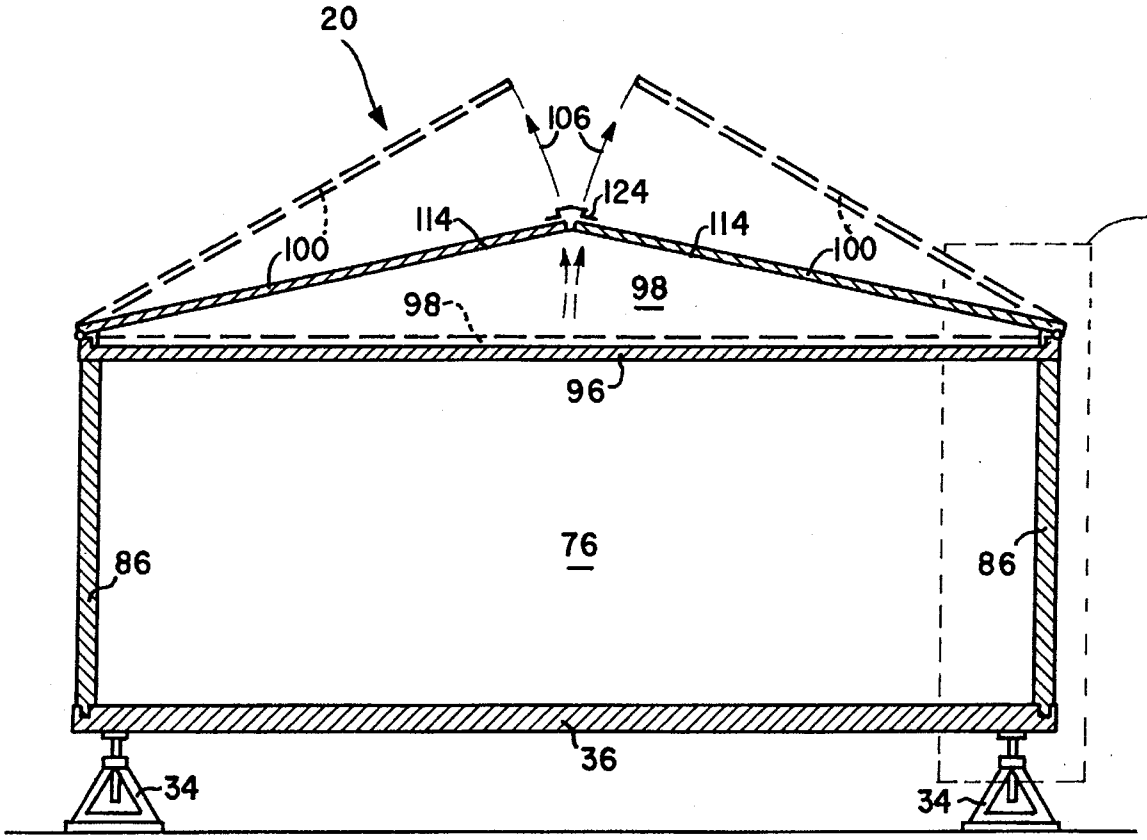
FIG. 14 is an end schematic view taken along line 14—14 of FIG. 13 showing the extension of the trusses into their extended position to form a support for the sloping roof panels in its fully position.

Referring to FIG. 15, a close-up of the connection of the outer roof members, trusses and wall sections is disclosed. Roof member 100 is shown hingedly connected to end beam 104 of base ceiling member 96 of roof section 52 about hinge 101. Roof member 100 hinges at hinge 101 between the retracted position and the extended position (shown in dotted outline). Truss 98 is shown in its erected supporting roof member 100 position and, in dotted outline, in its retracted position.

In summary it can be seen that the base ceiling members 96, the trusses 98 and outer roof members 100 provide a foldable roof system which can be erected from a retracted position and comprises, as a minimum, one base ceiling member supported horizontally, at least one pair of trusses hinged for rotation relative to the base ceiling member, and at least one outer roof member having a lower edge hingedly connected to the edge of the base ceiling member. The trusses are disposed parallel to each other to extend generally across the base ceiling member from the edge thereof. The trusses are hinged for rotation relative to the base member to permit rotation of the trusses from retracted positions thereof in which the trusses lie generally parallel and adjacent to the base ceiling member, to extended positions thereof in which the trusses extend upwardly from the base ceiling member. Each truss has at least one sloping top chord. The outer roof member has a proximal portion, generally adjacent a lower edge thereof, hingedly connected to the said edge of the base ceiling member. In this way, when the roof system is retracted, the outer roof member is generally parallel to the base ceiling panel and the trusses are in the retracted positions thereof and interposed between the other roof member and the base ceiling member. When the roof system is erected, the trusses are rotated to the extended positions thereof, and the outer roof member is rotated to be supported by the sloping top chord of the trusses so as to be inclined at an angle to the base ceiling member.

As depicted in FIG. 4, wall sections 82 and 86 may include windows 120 or a door 122 oriented in any suitable manner for use. It can be seen from FIG. 11 that, when wall sections 82 and 86 are in the collapsed position, windows 120 and door 122 are protected from damage by end wall section 76, as well as by the collapsed roof sections 52 and 54 and the collapsed floor sections 36 and 44.

In order to prevent water and other foreign material from leaking into the truss area of the roof when erected, a longitudinal roof apex cap 124 (FIGS. 5 and 14) may be fastened to the adjacent distal or upper portions of roof members 100 to overlie apex 116. As can be seen in FIG. 13, trusses are oriented to lie wholly within respective roof sections 52, 54 and 56 to enable roof sections 52, 54 and 56 to be unfolded and erected in the manner previously described. This permits trusses 98 to lie wholly within either roof section 52, 54 or 56.

In order to provide collapsed dimensions fitting within I.S.O. 1AA, 1BB or 1CC container sizes, sections 52 and 54 have a preferred width of about 90 inches. The width of section 52 is the distance between hinge 64 and hinge 70. The width of section 54 is the distance between hinge 70 and the opposite edge of section 54. This permits vertical suspension of sections 52 and 54 from main roof section 56 at hinges 64 without the roof sections 52 and 54 contacting main floor section 38. As well, if the height of the trusses, that is, the distance between the top of the ceiling joint 112 and the top of apex 116, is about 30 inches, three trusses will fit within each of roof sections 52 and 54.

Similarly, if main roof section 56 is about 60 inches wide (i.e., the distance between hinges 64 on each side of main roof section 56), then exactly two of such 30 inch trusses will fit within the main ceiling panel when the trusses are collapsed. In order to provide support at the center of roof section 56, section 56 may include center truss 111 which overlies truss 98 when in its retracted position.

The slope of the roof pitch, when the trusses are in their extended position, will depend on the length of roof sections 52, 54 and 56. In the example of the 1CC container-sized portable building 20, roof sections 52, 54 and 56 are each about 20 feet long. 30 inch high trusses will provide a one to four slope.

Figure 7A:
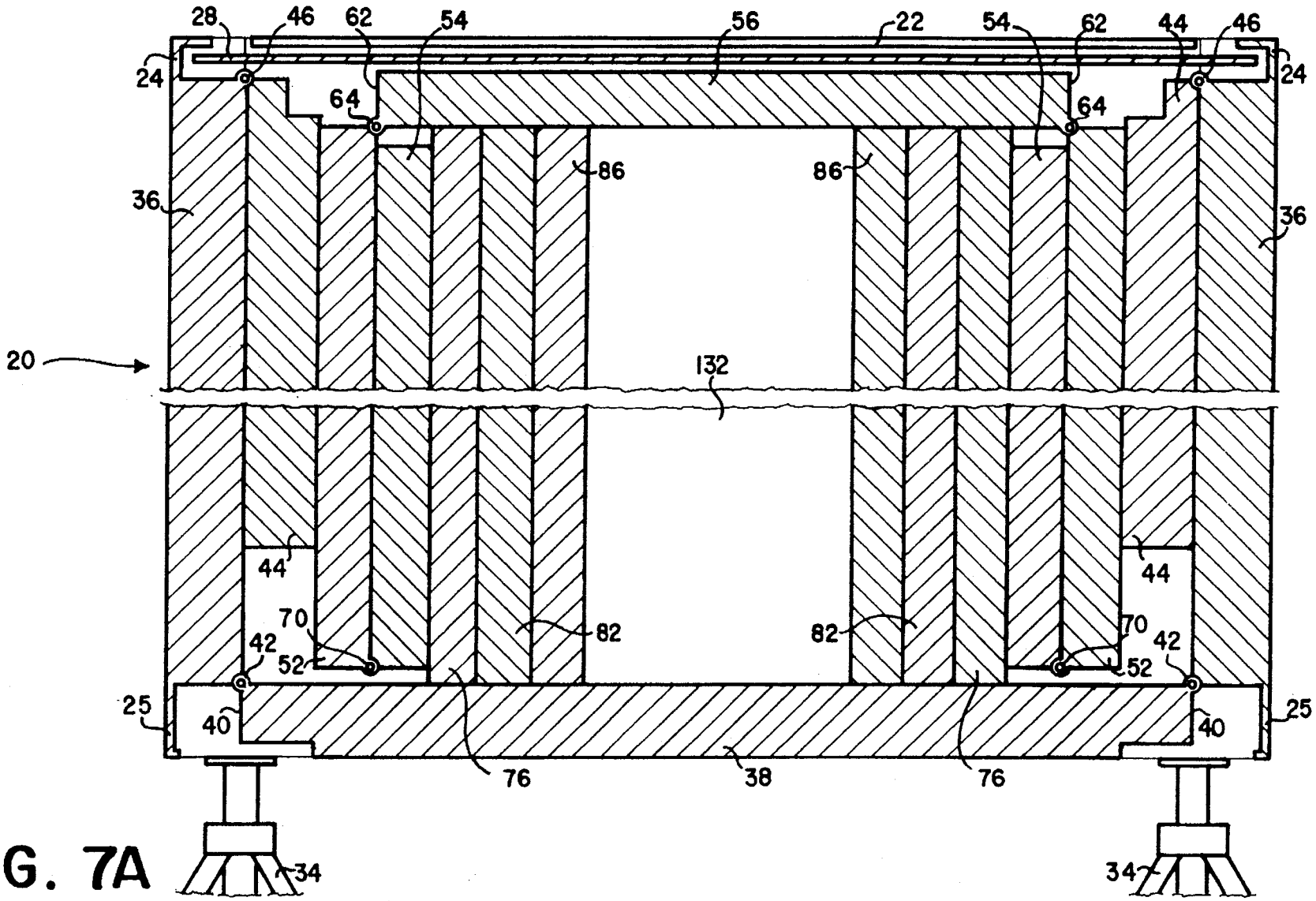
FIG. 7A is a close-up view of FIG. 7.

In summary, as best seen in FIGS. 7 and 7A, when the building is collapsed, the plurality of hingedly interconnected floor sections, wall sections and roof sections are all disposed generally vertically and stacked closely together to occupy a minimal volume. The main floor section 38 defines a bottom of the parallelepiped box-like container and normal exterior (i.e. lower) normal surfaces of the first floor section 36 and additional first floor section 36 define opposite sides of the container. Thus, the normal interior surfaces (i.e. upper finished floor surfaces) of the first floor sections 36 are protected when the building is collapsed. In addition, it is noted that the interior finished floor surfaces of the first and second floor sections 36 and 44 face each other when the building is folded. Similarly, the normal interior surfaces (i.e. the downward facing finished ceiling surfaces) of the first and second roof sections 52 and 54 also face each other when the building is folded. Thus, the possibly soiled floor surfaces can contact each other, and the usually relatively clean ceiling surfaces can contact each other, thus maintaining distinct separation between the interior floor and ceiling surfaces, and reducing possible contamination therebetween. It is also noted that the sides are essentially unobstructed so as to interfere minimally with normal storage and handling of the container using conventional equipment. The first, second and end wall sections 86, 82 and 76 respectively have upper and lower edges closely adjacent the main roof section and the main floor section respectively. In addition the first wall sections on each side of the main support are closely adjacent the main wall section, that is the central wall sections 58 located on each side of the main support. The plurality of roof sections are located on a side of the plurality of wall sections remote from the main wall section so that the plurality of roof sections are interposed between the wall sections and the floor sections on each side of the main support. It can be seen that distance between the first and second side edges 40 of the main floor section 38 is greater than distance between the first and the second side edges 62 of the main roof section 56. In fact, difference in the distance between the first and second side edges of the main floor section and the distance between the first and second side edges of the main roof section is equal to or greater than twice the thicknesses of the second floor section 44 and the first roof section 52. Optical support member 130 connects main roof section 56, central wall section 58 and main floor section 38 together to provide additional rigidity for the main support formed by the two central wall sections 58, the main floor section 38, and the main roof section 56. Optional support members 130 are perpendicular to the central wall sections 58.

As can be seen best in FIG. 6, when in its collapsed form, the wall sections 86, support member 130 and central wall sections 58 define cavity 132 in the main support at the center portion of collapsed building 20. Cavity 132 can be used to store various components of building 20 for shipment. For example, pre-finished interior partitions may be included to facilitate erection of interior walls. As well, cavity 132 can be used to ship furniture, fixtures, plumbing components, heating components, insulation material for the attic, electrical components, household appliances, etc. in order to provide an essentially self-contained building with all necessary components contained in one container-sized collapsed building. The support member 130 may also be fitted with plumbing and electrical fixtures connected and attached within the cavity 132.

As a preferred alternative, as seen in FIG. 1, the top pair of end edge supports 22 may include bolt receiving openings to control the movement of floor sections 44 and 36 and roof sections 52 and 54 from their collapsed vertical positions to their expanded horizontal positions. Bolt holding openings may also be used to control the bellows-like expansion of wall sections 82, 86 and 76. Outer openings (not shown) control movement of floor sections 36 and 44. Bolts (not shown) inserted in outer openings (not shown) retain floor sections 36 and 44 in their vertical collapsed position. On removal of the bolts from outer openings, floor sections 36 and 44 are free to rotate about hinge 42 to the horizontal position, as best depicted in FIG. 9.

Figure 12:
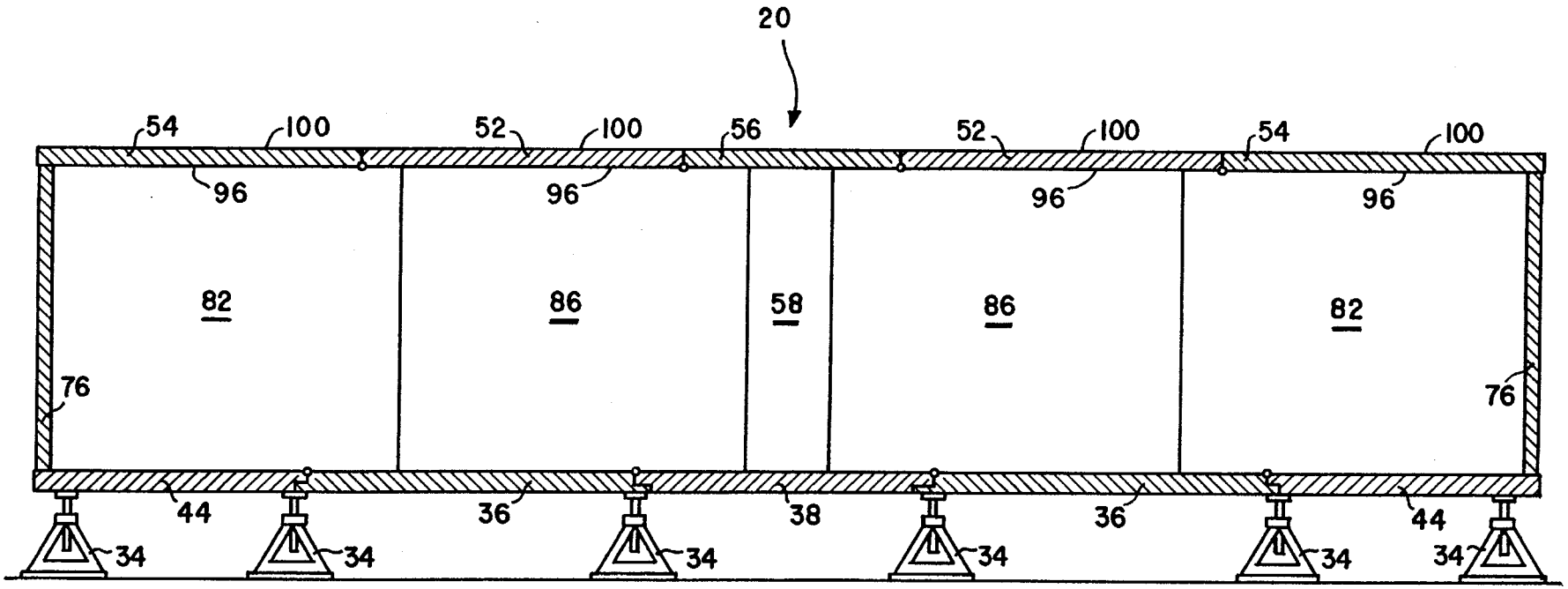
FIG. 12 is a side schematic view taken along line 12—12 of FIG. 11.

Bolts (not shown) inserted into proper openings retain wall sections 82, 86 and 76 in their collapsed position adjacent one another in parallel planar alignment, as depicted in FIG. 10. If the bolts are removed from outer openings, but not from inner openings, it can be seen that a controlled erection of floor sections 36 and 44 can occur, without interference from inadvertent opening and expansion of wall sections 82, 86 and 76. As well, gravity will hold roof sections 52 and 54 in vertical collapsed alignment. After roof sections 52 and 54 are rotated to their extended position, as depicted in FIG. 10, and upon insertion of temporary supports 66 and 72 to retain roof sections 52 and 54 in horizontal expanded position, bolts may be removed from inner openings to permit bellows-like expansion of wall sections 82, 86 and 76 to the expanded position, as depicted in FIGS. 11 and 12. In this manner, controlled expansion of the floor sections 36 and 44, and of the wall sections 82, 86 and 76, may be undertaken in a controlled, safe manner, without interference from other components.

Figure 5:
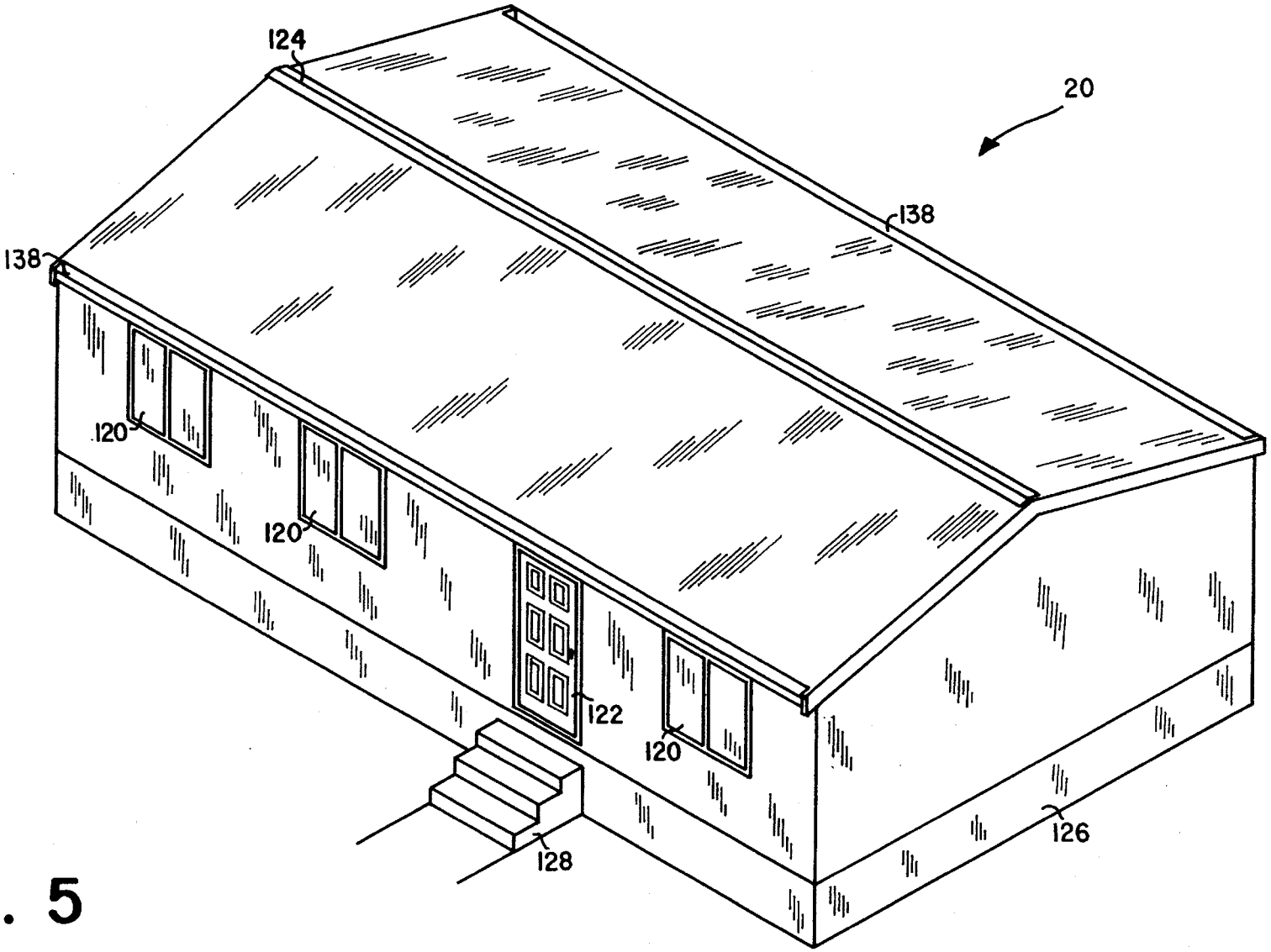
FIG. 5 is a perspective view of the building of FIG. 1 in its fully erected position.

As disclosed in FIG. 5, if desired, the crawl space between the floor sections 36, 38 and 44 may be covered by skirt member 126. As well, steps 128 may be positioned adjacent door 122 to facilitate entering and exiting building 20.

I claim:

1. A foldable portable building, comprising, when erected:

(a) a main support comprising a main floor section, a main wall section and a main roof section, the main wall section being supported on the main floor section and supporting the main roof section, the sections being rigidly interconnected, (b) a plurality of generally horizontal and planar hingedly interconnected floor sections, including a first floor section hingedly interconnected to the main floor section, (c) a plurality of generally horizontal and planar hingedly interconnected roof sections a spaced above the floor sections, and including a first roof section hingedly interconnected to the main roof section, and (d) a plurality of generally vertical, hingedly interconnected wall sections comprising at least one transversely disposed end wall section, two first wall sections and two second wall sections, the first and second wall sections being disposed adjacent opposite ends of the floor sections, the first and second wall sections having adjacent side edges hingedly connected to each other and opposite side edges hingedly connected to the main wall section and to the end wall section respectively to form a bellows shaped connection, at least one of the first, second or end wall sections being supported and guided by the floor sections as the wall sections move between retracted and extended positions thereof, upper edges of the wall sections being generally co-planar to each other to support thereon the roof sections extending therebetween, the upper edges of the wall sections being generally co-planar with a lower surface of the main roof section of the main support, the roof sections further comprising:

(i) at least one base ceiling member supported by the wall sections;

(ii) a pair of outer roof members, each outer roof member being hingedly connected to an opposite end edge of the base ceiling member for rotation of the outer roof members about respective axes of rotation relative to said base ceiling member; and (iii) a plurality of trusses disposed parallel to each other to extend generally across the base ceiling member from the opposite end edges thereof, the trusses being hinged for rotation relative to the base ceiling member to permit rotation of the trusses from retracted positions thereof in which the trusses lie generally parallel and adjacent to the base ceiling member, to extended positions thereof in which the trusses extend vertically from the base ceiling member, each truss having a sloping top chord reaching an apex, wherein the trusses lie generally horizontally between the outer roof members and the base ceiling member when in the retracted position, and wherein the outer roof members rest on the top chords of the trusses when the trusses are in the extended positions thereof.

2. A building as described in claim 1, wherein the main wall section comprises a pair of spaced opposed central wall sections, and the lower surface of the main roof section extends perpendicularly from the central wall sections.

3. A building as described in claim 2, wherein the main roof section is disposed above the main floor section, the main roof section being supported by the central wall sections and being coplanar with the plurality of roof sections, the main roof section having a first side edge hingedly connected to the first roof section.

4. A building as described in claim 3, wherein said main roof section has a second side edge disposed oppositely to the first side edge and hingedly connected to an additional first roof section of the plurality of roof sections on an opposite side of said building from the first roof section.

5. A building as described in claim 1 wherein the main floor section is located to be coplanar with the plurality of floor sections and is connected to and supporting the central wall sections.

6. A building as claimed in claim 5, wherein the first floor section has one side edge hingedly connected to the main floor section, and a second floor section of the plurality of floor sections is hingedly connected to an opposite side edge of the first floor section.

7. A building as described in claim 6, wherein the main floor section has a first side edge hingedly connected to the first floor section.

8. A building as described in claim 7, wherein the main floor section has a second side edge opposite the first side edge of the main floor section, the second side edge being hingedly connected to an additional first floor section of the plurality of floor sections located on an opposite side of the building from the first floor section.

9. A building as described in claim 8, wherein distance between the first and second side edges of the main floor section is greater than distance between first and second side edges of the main roof section.

10. A building as described in claim 9, wherein difference in the distance between the first and second side edges of the main floor section and the distance between the first and second side edges of the main roof section is equal to or greater than twice thicknesses of the second floor section plus the first roof section.

11. A building as described in claim 1, wherein each of said plurality of floor sections has a longitudinal groove extending perpendicularly to side edges of the respective floor section, and wherein the end wall section includes an extension extending from a lower edge of the end wall section, the extension being constrained to move within the groove for guiding the end wall section as the end wall section moves between retracted and extended positions thereof.

12. A building as described in claim 1, wherein each of the floor sections has a pair of longitudinal grooves extending perpendicularly to respective side edges of the floor section, and wherein a pair of extensions extend from opposite sides of a lower edge of the end wall section, said extensions being constrained to move within the grooves for guiding said end wall section as the wall sections move between the retracted and extended positions thereof.

13. A building as described in claim 1, wherein a plurality of trusses are confined within the periphery of the roof sections.

14. A building as described in claim 13, wherein the outer roof members extend from respective edges of the base ceiling member towards an opposite edge of the base ceiling member a distance greater than one-half the distance between the said edges of the base ceiling member, and wherein distal portions of the outer roof members of each roof section are adapted to overlie one another when in the retracted position, and wherein the distal portions of the outer roof members abut each other when the outer roof members are supported by the top chords of the trusses when the trusses are in the extended positions thereof.

15. A building as described in claim 14, further comprising an apex cap member extending along the abutting edges of the outer roof members to form a weather-resistant seal along the abutting edges.

16. A building as described in claim 1, further comprising a plurality of C-shaped temporary support members for generally vertical connection between a roof section and a floor section to temporarily support said roof section horizontally and spaced above the floor section as the wall sections move between the retracted and extended positions thereof.

17. A foldable roof system for a structure, in which the roof system can be erected from a retracted position thereof, the system comprising:

(a) a base ceiling member adapted to be supported generally horizontally and having an edge, (b) a plurality of trusses disposed parallel to each other to extend generally across the base ceiling member from the said edge thereof, the trusses being hinged for rotation relative to the base ceiling member to permit rotation of the trusses from retracted positions thereof in which the trusses lie generally parallel and adjacent to the base ceiling member, to extended positions thereof in which the trusses extend upwardly from the base ceiling member, each truss having at least one sloping top chord, and (c) an outer roof member having a proximal portion hingedly connected to the said edge of the base ceiling member so that, when the roof system is retracted, the outer roof member is generally parallel to the base ceiling member and the trusses are in the retracted positions thereof and interposed between the outer roof member and the base ceiling member and, when the roof system is erected, the trusses are rotated to the extended positions thereof, and the outer roof member is rotated to be supported by the top chords of the trusses so as to be inclined at an angle to the base ceiling member.

18. A roof system as claimed in claim 17, in which:

(a) the trusses are hinged for rotation relative to the base ceiling members about respective truss hinges, and (b) the outer roof members are hinged for rotation about respective roof member hinges disposed perpendicularly to the truss hinges.

19. A foldable roof system for a structure, in which the roof system can be erected from a retracted position thereof, the system comprising:

(a) at least one base ceiling member supportable generally horizontally and having respective oppositely located edges, (b) a plurality of trusses hingedly connected to the base ceiling member, the trusses being disposed parallel to each other to extend generally across the respective base ceiling member between the respective edges thereof, the trusses being hinged for rotation relative to the respective base ceiling member to permit rotation of the trusses from retracted positions thereof in which the trusses lie generally parallel and adjacent to the respective base ceiling member to extended positions thereof in which the trusses extend upwardly from the respective base ceiling member, each truss having at least one sloping top chord, and (c) at least one pair of outer roof members, each pair of outer roof members having proximal portions hingedly connected to opposite edges of the respective base ceiling member, so that when the roof system is retracted, the outer roof members are generally parallel to the respective base ceiling member, and the trusses are in retracted positions thereof and interposed between the outer roof members and the respective base ceiling member, and distal portions of each pair of outer roof members overlap each other, and when the roof system is erected, the trusses are rotated to the extended positions thereof and the outer roof members of a particular pair of outer roof members are rotated to be supported by the top chords of the trusses so as to be inclined at respective angles to the respective base ceiling member, with the distal portions of each pair of outer roof members being generally adjacent each other at an uppermost position of the roof.

20. A roof system as claimed in claim 19, in which:

(a) each truss has a pair of sloping top chords.

21. A roof system as claimed in claim 20, in which:

(a) the sloping top chords of each truss meet at an apex, and (b) a longitudinal apex cap extends along and is connected to the adjacent distal portions of the outer roof members to overlie the apex of each truss.

22. A roof system as claimed in claim 19, in which:

(a) the trusses are hinged for rotation relative to the base ceiling members about respective truss hinges, and (b) the outer roof members are hinged for rotation about respective roof member hinges disposed perpendicularly to the truss hinges.

23. A foldable portable building, comprising, when folded:

(a) a main support comprising a main floor section, a main wall section and a main roof section, the main wall section being supported on the main floor section and supporting the main roof section, the sections being rigidly interconnected and the main floor section defining a bottom of a parallelepiped box-shaped container, (b) a plurality of generally vertical, hingedly interconnected floor sections including a first floor section hingedly interconnected to the main floor section and extending vertically from the main floor section to define one side of the box-shaped container, the side being essentially unobstructed, (c) a plurality of generally vertical, hingedly interconnected wall sections comprising at least one transversely disposed end wall section, two first wall sections and two second wall sections, the first and second wall sections having adjacent side edges hingedly connected to each other and opposite side edges hingedly connected to the main wall section and to the end wall section respectively to form a bellows shaped connection; the first, second and end wall sections having upper and lower edges closely adjacent the main roof section and the main floor section respectively, and the first wall sections being closely adjacent the main wall section, and (d) a plurality of generally vertical, hingedly interconnected roof sections, including a first roof section hingedly interconnected to the main roof section, the plurality of roof sections being located on a side of the plurality of wall sections remote from the main wall section so that the plurality of roof sections are interposed between the wall sections and the floor sections.

wherein, (i) the first floor section has a normal interior surface and an oppositely facing normal exterior surface, which face upwardly and downwardly respectively when the building is erected, and face inwardly and outwardly respectively when the building is collapsed, so as to protect the interior surface of the first floor section when the building is collapsed, (ii) the plurality of floor sections include a second floor section which is hingedly connected to the first floor section, the second floor section having a normal interior surface and an oppositely facing normal exterior surface, which face upwardly and downwardly respectively when the building is erected, and face outwardly and inwardly respectively when the building is collapsed, so that the interior surfaces of the first and second floor sections face each other when the building is collapsed, and (iii) the plurality of roof sections include a second roof section hingedly interconnected to the first roof section, the first and second roof sections having normal interior ceiling surfaces which face downwardly when the building is erected, and face each other when the building is collapsed, so as to maintain distinct separation between the interior floor and ceiling surfaces thus reducing contamination therebetween.

24. A building as described in claim 23, in which:

(a) the plurality of generally vertical, hingedly interconnected wall sections further comprise, on an opposite side of the main support, an additional transversely disposed end wall section, two additional first wall sections and two additional second wall sections, the additional first and second wall sections having adjacent side edges hingedly connected to each other and opposite side edges hingedly connected to the opposite side of the main wall section, and to the additional end wall section respectively to form a bellows shaped connection; the additional wall sections having upper and lower edges closely adjacent the main roof section and the main floor section respectively, and the additional first wall sections are closely adjacent the opposite side of the main wall section, so as to provide two separate groups of interconnected wall sections, one such group being located on each side of the main wall section, (b) the plurality of generally vertical, hingedly interconnected roof sections further comprise, on an opposite side of the main support, additional interconnected roof sections including an additional first roof section hingedly interconnected to an opposite side of the main roof section so as to provide two groups of interconnected roof sections, one such group being located on each outer side of the two groups of wall sections remote from the main wall section, and (c) the plurality of hingedly interconnected floor sections further comprise, on an opposite side of the main support, additional interconnected floor sections including an additional first floor section hingedly interconnected to an opposite side of the main floor section to provide two groups of interconnected floor sections, one such group being located on each outer side of the two groups of roof sections remote from the main wall section, so that the two groups of floor sections are located outwardly of the two groups of roof sections, and the roof sections are located on each side of the main wall section and disposed between the wall sections and floor sections located on each side of the main wall section, and the first floor section and additional first floor section define opposite sides of the box-shaped container, the sides being essentially unobstructed.

25. A building as described in claim 23, in which each roof section comprises:

(a) at least one base ceiling member, (b) an outer roof member hingedly connected to an edge of the base ceiling member for rotation of the outer roof member about an axis of rotation relative to the said base ceiling member, and (c) a plurality of trusses disposed parallel to each other to extend generally across the base ceiling member between opposite edges thereof, the trusses being hinged for rotation between extended and retracted positions thereof relative to the base ceiling member, so that when the roof section is retracted, the trusses are interposed between the respective outer roof member and the base ceiling member.

26. A building as described in claim 25, in which:

(a) the trusses are hinged for rotation relative to the base ceiling members about truss hinges, and (b) the outer roof member is hinged for rotation about a roof member hinge disposed perpendicularly to the truss hinges.

27. A building as described in claim 23, in which the roof sections comprise:

(a) a plurality of hingedly interconnected base ceiling members having respective oppositely located edges, (b) a plurality of trusses hingedly connected to each said base ceiling member, the trusses being disposed parallel to each other to extend generally across the respective base ceiling members between the respective edges thereof, the trusses being hinged for rotation between extended and retracted positions thereof relative to the respective base ceiling member, and (c) a plurality of pairs of outer roof members, each pair of outer roof members having proximal portions hingedly connected to the opposite edges of the respective base ceiling member, so that when the roof sections are retracted, the trusses are interposed between the respective outer roof members and the respective base ceiling members.

28. A building as claimed in claim 27 in which:

(a) the trusses are hinged for rotation relative to the base ceiling member about respective truss hinges, and (b) the outer roof members are hinged for rotation about respective roof member hinges disposed perpendicularly to the truss hinges.

29. A building as described in claim 23, wherein the dimensions and handling characteristics of the container are compatible with an ISO 1AA, 1BB, 1CC or a "high cube" container.

* * * * *